US009884486B2

(12) United States Patent
Harayama et al.

(10) Patent No.: US 9,884,486 B2
(45) Date of Patent: Feb. 6, 2018

(54) PRINTING APPARATUS

(71) Applicant: MIMAKI ENGINEERING CO., LTD., Nagano (JP)

(72) Inventors: Ryuta Harayama, Nagano (JP); Shunsuke Akuta, Nagano (JP); Katsutoshi Yamabe, Nagano (JP); Tomonori Amari, Nagano (JP); Yoshikazu Furukawa, Nagano (JP); Hiroki Kamimura, Nagano (JP); Yusaku Kudo, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 15/152,565

(22) Filed: May 12, 2016

(65) Prior Publication Data

US 2016/0332462 A1 Nov. 17, 2016

(30) Foreign Application Priority Data

May 15, 2015 (JP) ..... 2015-100579

(51) Int. Cl.
*B41J 11/00* (2006.01)
*B41J 2/01* (2006.01)

(52) U.S. Cl.
CPC ..... *B41J 11/0015* (2013.01); *B41J 11/002* (2013.01); *B41J 2/01* (2013.01)

(58) Field of Classification Search
CPC ..... B41J 11/0015; B41J 11/002; B41J 2/01
See application file for complete search history.

(56) References Cited

U.S. PATENT DOCUMENTS 9,010,920 B2 * 4/2015 Nishimura ..... B41J 11/002 347/102

FOREIGN PATENT DOCUMENTS

JP 2001-334647 12/2001

* cited by examiner

*Primary Examiner* — Henok Legesse
(74) *Attorney, Agent, or Firm* — JCIPRNET

(57) ABSTRACT

A printing apparatus is provided and includes: a head that ejects ink onto a medium; a driver that relatively moves the positions of the head and the medium; a cover member that is positioned on the downstream side from the head in the movement direction of the medium relative to the head, so as to cover at least a portion of the medium; an air blowing fan that sends a drying air flow for drying ink ejected on the medium, into a gap between the medium and the cover member; and a cord type heater that heats at least one of the drying air flow and a preliminary air which is the previous stage of the drying air flow. An air-flow-direction changing wall part is provided so as to change the flow direction of the preliminary air which is the previous stage of the drying air flow, at least once.

16 Claims, 18 Drawing Sheets

PRINTING APPARATUS

CROSS REFERENCE TO RELATED APPLICATIONS

This application claims the priority benefit of Japanese Patent Application No. 2015-100579, filed on May 15, 2015. The entirety of the above-mentioned patent application is hereby incorporated by reference herein and made a part of this specification.

TECHNICAL FIELD

The present disclosure relates to a printing apparatus.

RELATED ART

Printing apparatuses using inkjet heads jet ink from the inkjet heads onto media such as recording paper, thereby performing printing. However, in a case where ink is slowly dried, wet ink may be mixed, resulting in a decrease in chroma or blurring of images. Especially, in printing apparatuses, such as line printers, which eject ink in units of lines extending in a main scan direction while conveying media, since the amount of ink ejection relative to the medium conveyance speed is large, it is difficult for ink to be dried. For this reason, conventional printing apparatuses which positively dry ink ejected on media are described.

For example, an inkjet printer disclosed in JP-A-2001-334647 blows warm air to media after printing, thereby drying ink ejected on the media. However, warm air flows between an inkjet head and a medium, ink ejection positions on the medium may be deviated from predetermined positions, resulting in a degradation in the printing quality. In order to prevent this problem, in the above described inkjet printer, the warm-air blowing direction is set to the medium conveyance direction.

However, in a case of blowing warm air directly to a medium by a fan, so-called "cockling" which is a phenomenon that temperature on the medium becomes uneven, and this uneven temperature causes difference in drying time, whereby wrinkles are made in a wave shape in the medium may occur. Also, in the case of blowing warm air directly to a medium, since temperature management is likely to be insufficiently performed, cockling may be caused by drying failure attributable to deficiency in the amount of heat or excessive heating. Also, although it is preferable that the ink drying time should be very short, rapid drying which is performed by increasing the amount of warm air or raising the temperature of warm air, or uneven drying is likely to lead to occurrence of cockling. As described above, it has been very difficult to dry ink ejected on media without causing cockling.

SUMMARY

The present disclosure is made in view of the above described circumstances, and the present disclosure provides a printing apparatus capable of drying ink on media while suppressing cockling from occurring.

In order to solve the above described problems, a printing apparatus according to the present disclosure includes: a head that ejects an ink onto a recording medium; a driver that relatively moves positions of the head and the recording medium; a cover member that is positioned on a downstream side from the head in a movement direction of the recording medium relative to the head, so as to cover at least a portion of the recording medium; a drying-air-flow supply that sends a drying air flow for drying the ink ejected on the recording medium, into a gap between the recording medium and the cover member; and a heater that heats at least one of the drying air flow and a preliminary air which is a previous stage of the drying air flow, wherein a flow path changer is provided so as to change a flow direction of the preliminary air which is the previous stage of the drying air flow, at least once.

In this disclosure, since the flow direction of the preliminary air which is the previous stage of the drying air flow is changed by the flow path changer, and then the preliminary air is sent as the drying air flow toward the gap between the recording medium and the cover member, it is possible to suppress the preliminary air from straightly flowing. Therefore, it is possible to suppress an uneven air flow from being created on the recording medium, and it is possible to suppress cockling from occurring. As a result, it is possible to dry the ink on the recording medium while suppressing cockling from occurring. Also, since at least one of the air from the air blower and the cover member is heated by the heater, and an air flow with little unevenness is used to raise the temperature of the drying air flow for drying the ink, it is possible to easily perform temperature management during drying of the ink.

Also, in the above described printing apparatus, the drying-air-flow supply may be an air blower for blowing the preliminary air, and the flow path changer may be an air-flow-direction changing wall part configured such that the preliminary air blown from the air blower collides with the air-flow-direction changing wall part, whereby the flow direction of the preliminary air is changed.

In this disclosure, since the air blower blows the preliminary air, whereby the preliminary air collides with the air-flow-direction changing wall part, whereby the flow direction is changed such that the preliminary air is used as the drying air flow, it is possible to easily create the drying air flow to flow toward the gap between the recording medium and the cover member. As a result, it is possible to easily dry the ink on the recording medium.

Also, in the above described printing apparatus, a widening duct in fan shape that spreads the preliminary air blown by the air blower, in a direction perpendicular to the movement direction of the recording medium may be disposed, and in the widening duct, near a leading end portion in an air blowing direction, a plurality of current plates extending in the flow direction of the preliminary air blown from the air blower may be provided in a line in a width direction.

In this disclosure, since the plurality of current plates is disposed inside the widening duct, it is possible to evenly send air out from an opening of the widening duct, and it is possible to evenly send air into an air flow path. As a result, the volume of air flow is uniformized, and it is possible to suppress unevenness in heating which is performed by the heater, and it is possible to suppress the ink from being unevenly dried.

Also, in the above described printing apparatus, the flow path changer may be an air blower for blowing the preliminary air positioned on an opposite side of the cover member to the recording medium, into the gap between the recording medium and the cover member.

In this disclosure, since the preliminary air positioned on the opposite side of the cover member to the recording medium is blown into the gap between the recording medium and the cover member by the air blower, it is possible to use the preliminary air as the drying air flow by changing the flow direction of the preliminary air. Therefore, it is possible to easily send the drying air flow toward the gap between the recording medium and the cover member, and it is possible to easily dry the ink on the recording medium by the drying air flow.

Also, in the above described printing apparatus, the flow path changer may be an air breather for sucking the drying air flow.

In this disclosure, since the drying air flow between the recording medium and the cover member is sucked by the air breather, it is possible to produce a negative pressure in the gap between the recording medium and the cover member, and this negative pressure causes the flow direction of the preliminary air positioned on the opposite side of the cover member to the recording medium to change such that the preliminary air flows into the gap between the recording medium and the cover member. Therefore, it is possible to easily send the drying air flow toward the gap between the recording medium and the cover member, and it is possible to easily dry the ink on the recording medium by the drying air flow.

Also, in the above described printing apparatus, the flow path changer may change the flow direction of the preliminary air such that the preliminary air flows toward a lower side in the gap between the recording medium and the cover member.

In this disclosure, since the preliminary air blown from the air blower is sent downward, thereby flowing as the drying air flow toward the gap between the recording medium and the cover member, in a case where air is heated by the heater, thereby flowing upward, it is possible to direct the flow of air downward. As a result, it is possible to make warm air stay between the cover member and the recording medium, and it is possible to improve drying efficiency. Also, since air blown from the air blower is directed downward, it is possible to make it difficult for heat generated by the heater to be transferred to the head. Therefore, it is possible to reduce adverse effects such as poor ink ejection attributable to drying of nozzles.

Also, in the above described printing apparatus, the heater may comprise a cord type heater, and be bonded to the cover member, and the heater may heat the cover member, thereby heating the drying air flow.

In this disclosure, since the heater heats the cover member, thereby heating the drying air flow in the air flow path, it is possible to perform temperature management by detecting the temperature of the cover member, and it is possible to improve the reliability of temperature management. Also, in a case of heating the drying air flow in the air flow path, the cover member is also heated. Therefore, it is possible to improve heating efficiency during heating of the drying air flow. Also, since the inexpensive cord type heater is used as the heater, it is possible to suppress the manufacturing cost. Further, since the cord type heater is bonded to the cover member, it is possible to thin a cover for covering the cord type heater, and it is possible to make the whole apparatus compact.

Also, in the above described printing apparatus, the cord type heater may be disposed throughout a width direction of the recording medium in a direction perpendicular to the movement direction of the recording medium.

In this disclosure, since the cord type heater is provided throughout the width direction of the recording medium in the main scan direction, it is possible to suppress a reduction in temperature at joints of heaters. In other words, for example, unlike in a case of using glass tube heaters or sheath heaters as the heater, it is possible to suppress a reduction in temperature at joints. As a result, it is possible to more surely and evenly heat air in the air flow path.

Also, in the above described printing apparatus, after the flow direction of all of the preliminary air is changed by the flow path changer, the preliminary air may be used as the drying air flow.

In this disclosure, after the flow direction of all of the preliminary air is changed by the air-flow-direction changing wall part, whereby unevenness of the air flow is reduced, the preliminary air is sent as the drying air flow into the gap between the recording medium and the cover member. Therefore, it is possible to suppress a drying air flow having been unevenly heated from coming into contact with the recording medium. As a result, it is possible to more surely suppress cockling attributable to uneven drying or a variation in temperature.

Also, in the above described printing apparatus, between the head and an air outlet from which an air is sent out after the flow direction of the air is changed by the flow path changer, a partition plate may be disposed to separate the air outlet and the head.

In this disclosure, since the partition plate is provided between the air outlet and the head, it is possible to suppress a flow of heated air from reaching the head, thereby suppressing the heated air from drying ink on ejection ports of the head. As a result, printing failures are prevented from being caused by drying of ink on the ejection ports of the head, and it is possible to dry ink on the recording medium.

Also, in the above described printing apparatus, the cover member may include: a first cover part, and a second cover part which is positioned on the downstream side from the first cover part in the movement direction of the recording medium, and on the cover member, a rotator which rotates on a rotating shaft extending in a direction perpendicular to the movement direction of the recording medium may be connected, and the first cover part and the second cover part may be connected by the rotator so as to be rotatable with respect to each other.

In this disclosure, since the first cover part and the second cover part are connected so as to be able to relatively rotate, it is possible to fold the first cover part and the second cover part on the occasion of setting a recording medium, and to unfold the first cover part and the second cover part on the occasion of starting printing. As a result, it is possible to suppress ease of setting of a recording medium from being damaged, and provide the cover member at a position facing a recording medium. Also, even in a case where a recording medium is jammed, or a trouble occurs in the heater or the like, if necessary, it is possible to unfold and fold the first cover part and the second cover part, whereby it is possible to easily handle those troubles. As a result, it is possible to improve maintainability.

Also, the above described printing apparatus may further include: an after-platen that supports a portion of the recording medium positioned on the downstream side from the head in the movement direction of the recording medium relative to the head; and a recording-medium heater that is disposed on the after-platen, and heats the recording medium, wherein the recording-medium heater is configured such that a downstream area in the movement direction of the recording medium heats the recording medium at a higher temperature as compared to an upstream area.

In this disclosure, when ink ejected on the recording medium is dried by the recording-medium heater, the upstream area in the movement direction of the recording medium serves as a buffer zone, whereby it is possible to suppress sudden drying. As a result, it is possible to suppress cockling from occurring.

Also, the above described printing apparatus may further include: recording medium members that regulate movement of the recording medium in a width direction and a thickness direction of the recording medium, wherein, in the movement direction of the recording medium relative to the head, the recording medium members are disposed in an area where the head ejects the ink onto the recording medium.

In this disclosure, since it is possible to regulate movement of a recording medium in the width direction and the thickness direction of the recording medium by the recording medium members when the head ejects the ink onto the recording medium, it is possible to suppress cockling from occurring.

Also, the above described printing apparatus may further include: an after-platen that supports a portion of the recording medium positioned on the downstream side from the head in the movement direction of the recording medium relative to the head; a recording-medium heater that is disposed on the after-platen, and heats the recording medium; and recording medium members that regulate movement of the recording medium in a width direction and a thickness direction of the recording medium, wherein, in the movement direction of the recording medium relative to the head, the recording medium members are disposed throughout an area where the head ejects the ink onto the recording medium and a position of an upstream end of an area where the recording-medium heater is disposed.

In this disclosure, in a state where ink ejected on the recording medium is wet, it is possible to hold the recording medium by the recording medium members. In this way, while being held by the recording medium members, the recording medium moves to the area where the recording-medium heater is disposed. Therefore, after a predetermined time from ink ejection, it is possible to dry ink in the area where the recording-medium heater is disposed. Therefore, it becomes difficult for a recording medium to be suddenly deformed, and it is possible to effectively suppress cockling from occurring.

Also, a printing apparatus according to the present disclosure includes: a head that ejects an ink onto a recording medium; a driver that relatively moves the positions of the head and the recording medium; a platen for mounting the recording medium; a cover member that is positioned on a downstream side from the head in a movement direction of the recording medium relative to the head, so as to cover at least a portion of the recording medium; a drying-air-flow supply that sends a drying air flow for drying the ink ejected on the recording medium, into a gap between the recording medium and the cover member; and a heater that heats at least one of the drying air flow and a preliminary air which is a previous stage of the drying air flow, wherein the cover member is a boxed member formed in a box shape and having an internal space filled with air, and the boxed member contains the heater and the drying-air-flow supply.

In this disclosure, since the heater and the drying-air-flow supply are stored inside the boxed member formed as the cover member, it is possible to improve heating efficiency due to heat insulating effect while saving space. Therefore, it is possible to evenly heat the space between the cover member and the recording medium, and it is possible to suppress temperature unevenness. As a result, it is possible to dry ink on the recording medium while suppressing cockling from occurring.

Also, in the above described printing apparatus, the drying-air-flow supply may be disposed on an opposite side of the heater to the platen.

In this disclosure, since the drying-air-flow supply is disposed at a position on the opposite side of the heater to the platen, so as to overlap the heater, it is possible to suppress the drying-air-flow supply from protruding outward from the heater disposition area where the heater is disposed, thereby suppressing the drying-air-flow supply from occupying a large space. As a result, it is possible to save space.

Also, in the above described printing apparatus, the cover member may be formed in long shape along the platen in a direction of gravity, and an opening for sending out the drying air flow or the preliminary air may be formed at a top of the boxed member in the direction of gravity, and the drying air flow or the preliminary air may be sent from the opening by the drying-air-flow supply, whereby the drying air flow is introduced into the gap between the platen and the cover member.

In this disclosure, since the drying air flow or the preliminary air is sent from the opening formed at the top of the boxed member, it is possible to suppress the heated drying air flow positioned between the platen and the cover member from exiting from the upper side in the direction of gravity. As a result, it is possible to further improve heating efficiency.

The printing apparatus according to the present disclosure has an effect that it is possible to dry ink on media while suppressing cockling from occurring.

DETAILED DESCRIPTION OF EMBODIMENTS

Hereinafter, an embodiment of a printing apparatus according to the present disclosure will be described in detail with reference to the accompanying drawings. However, the present disclosure is not limited by the embodiment. Also, in components of the following embodiment, ones with which person skilled in the art can easily substitute the components, and ones which are substantially identical to the components are included.

Embodiment

Figure 1:
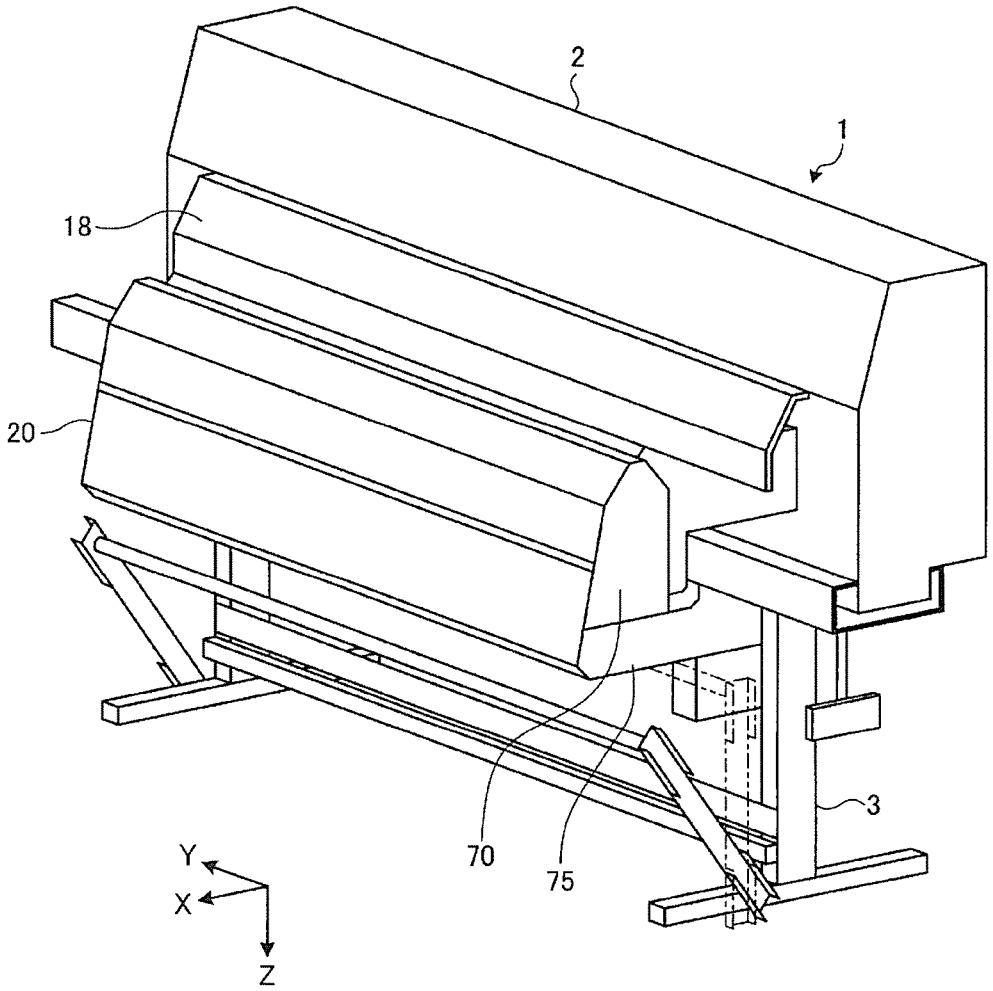
FIG. 1 is a perspective view of a printing apparatus according to an embodiment.
Figure 2:
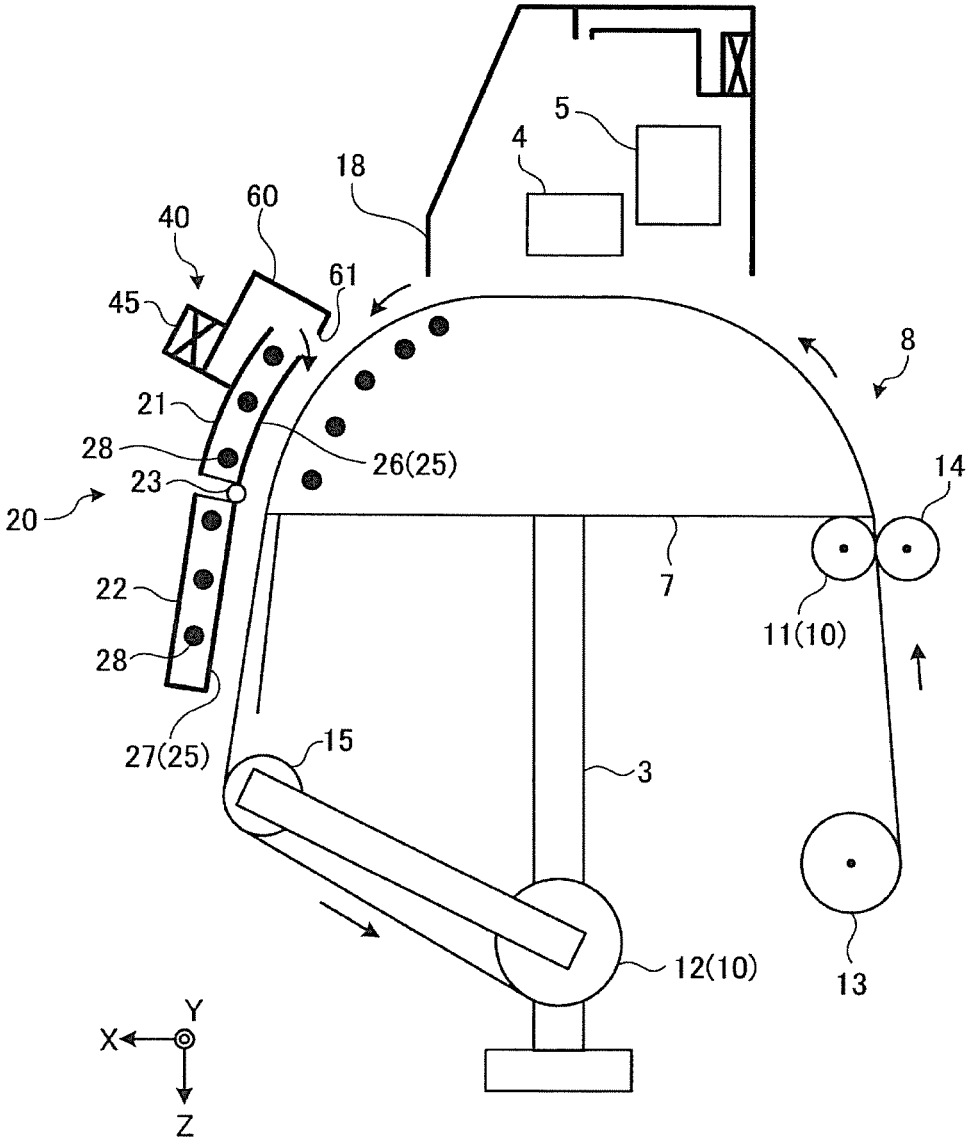
FIG. 2 is a schematic view illustrating the configuration of the printing apparatus shown in FIG. 1.

FIG. 1 is a perspective view of a printing apparatus of an embodiment. FIG. 2 is a schematic view illustrating the configuration of the printing apparatus shown in FIG. 1. A printing apparatus 1 according to the present embodiment is configured by assembling a dryer 20 with a printing apparatus main body 2, and the printing apparatus main body 2 includes: a head 4, a platen 7, and a driver 10. The printing apparatus main body 2 is supported by legs 3, which are placed at desired positions on the ground, whereby the printing apparatus main body 2 is installed at an arbitrary installation position. The head 4 included in the printing apparatus main body 2 is configured to be able to eject ink onto a medium 100 which is a recording medium when performing printing on the medium 100. The head 4 is configured to be able to eject ink while moving along a Y bar 5 extending in one direction, and the movement direction of the head 4 is a main scan direction (a Y direction in the drawings) when the printing apparatus 1 performs printing.

Also, the platen 7 is composed of a mounting table for mounting the medium 100 on the occasion of ejecting ink onto the medium 100. The head 4 is disposed above the platen 7, so as to be able to eject ink onto the medium 100 from the above of the medium 100 mounted on the platen 7.

Also, the driver 10 is configured so as to be able to relatively move the positions of the head 4 and the medium 100. Since the medium 100 is wound like a roll in advance by a medium feeding roller 13 for winding a medium 100 before printing, when the printing apparatus 1 performs printing, the driver 10 relatively moves the medium 100 with respect to the head 4 while drawing the medium wounded around the medium feeding roller 13. The direction in which the driver 10 moves the medium 100 with respect to the head 4 is a sub scan direction (an X direction in the drawings) which is a direction perpendicular to both of the main scan direction and an up and down direction (a Z direction in the drawings) in the normal use mode of the printing apparatus 1.

The driver 10 which moves the medium 100 in the sub scan direction includes: a drive roller 11 which draws the medium 100 from the medium feeding roller 13 and conveys the medium 100 to a side of the head 4, and a winding roller 12 which winds the medium 100 after ink is ejected from the head 4. All of the drive roller 11, the winding roller 12, and the medium feeding roller 13 are composed of rollers having rotating shafts which are disposed in the main scan direction. Also, the medium feeding roller 13 and the winding roller 12 are disposed below the platen 7. Therefore, the medium 100 is disposed from the lower side toward the upper side over an area from the medium feeding roller 13 to the platen 7, and is disposed from the upper side toward the lower side over an area from the platen 7 to the winding roller 12.

Both of the drive roller 11 and the winding roller 12 included in the driver 10 are configured to be able to receive power from an electric motor (not shown) which is a power source, and be rotatable by power transmitted from the electric motor. Their rotation directions are directions making it possible to convey the medium 100 from the drive roller 11 to the winding roller 12 through the gap between the head 4 and the platen 7, and the rotation speed of the winding roller 12 is higher than the rotation speed of the drive roller 11.

Also, the drive roller 11 is configured to be able to rotate on the rotating shaft while bringing the outer circumferential surface into contact with the medium 100, thereby conveying the medium 100 being in contact with the outer circumferential surface to the side of the head 4. As described above, at a position where the outer circumferential surface of the drive roller 11 comes into contact with the medium 100, on the opposite side of the medium 100 to the side which comes into contact with the outer circumferential surface of the drive roller 11, a driven roller 14 is disposed such that its outer circumferential surface comes into contact with the medium 100, similarly to the drive roller 11. In other words, the medium 100 is threaded from the medium feeding roller 13 toward the gap between the head 4 and the platen 7 through the gap between the drive roller 11 and the driven roller 14. While the driven roller 14 rotates according to movement of the medium 100 attributable to rotation of the drive roller 11, it comes into contact with the medium 100, thereby applying a biasing force in a direction for pressing the medium 100 against the drive roller 11.

The winding roller 12 is positioned on the downstream side from the platen 7 in the movement direction of the medium 100 which is moved by the driver 10, that is, the conveyance direction of the medium 100, and is configured to be able to wind the medium 100 which is fed by the drive roller 11.

Between the winding roller 12 and the platen 7, a positioning roller 15 is provided so as to apply a biasing force to the medium 100, thereby tensioning a portion of the medium 100 which is positioned between the positioning roller 15 and the platen 7. At a position on the downstream side from the platen 7 in the conveyance direction of the medium 100, the positioning roller 15 comes into contact with, for example, a surface of the medium 100 on the side being in contact with the platen 7, thereby applying the biasing force to the medium 100. Since the winding roller 12 is disposed on the downstream side from the positioning roller 15 in the conveyance direction of the medium 100, in an area which is positioned on the downstream side from the platen 7 in the conveyance direction of the medium 100, the upstream side and downstream side of the positioning roller 15 differ in the conveyance direction. The path which starts from the medium feeding roller 13, passes through the gap between the drive roller 11 and the driven roller 14, passes the top of the platen 7, and leads to the winding roller 12 through the positioning roller 15 is a conveyance path 8 which is a path in which the medium 100 is conveyed.

The dryer 20 included in the printing apparatus 1 according to the present embodiment is disposed on the downstream side from an area where the head 4 is disposed, in the conveyance direction of the medium 100, so as to face the surface of the medium 100 to which ink ejected from the head 4 attaches. More specifically, the dryer 20 is disposed so as to face a portion of the medium 100 which is positioned between the head 4 and the positioning roller 15 in the conveyance direction of the medium 100. In other words, the dryer 20 is disposed so as to face a portion of the medium 100 disposed from the upper side toward the lower side in a portion of the conveyance path from the platen 7 toward the positioning roller 15 and the winding roller 12. Also, the width of the dryer 20 in the main scan direction is set to a width larger than the width of the medium 100 in the main scan direction.

The dryer 20 includes: a first heating element 21, and a second heating element 22 which is disposed below the first heating element 21. In other words, the second heating element 22 is disposed on the downstream side from the first heating element 21 in the conveyance direction of the medium 100. Both of the first heating element 21 and the second heating element 22 are composed of boxy members formed in box shapes and having internal spaces filled with air. The first heating element 21 and the second heating element 22 are formed so as to extend in the main scan direction, and are connected to each other by a hinge 23 which is a rotator which rotates on a rotating shaft extending in the main scan direction of the head 4. The hinge 23 is connected to a lower end portion of the first heating element 21 and an upper end portion of the second heating element 22, whereby the first heating element 21 and the second heating element 22 become able to relatively rotate on the rotating shaft of the hinge 23. Since the first heating element 21 and the second heating element 22 become able to relatively rotate by the hinge 23 as described above, the dryer 20 becomes able to expand and contract in a direction along the conveyance path 8.

The first heating element 21 and the second heating element 22 have cover members 25 on their sides facing the medium 100. The cover members 25 include: a first cover part 26, and a second cover part 27 which is positioned on the downstream side from the first cover part 26 in the movement direction of the medium 100, and are positioned on the downstream side from the head 4 in the movement direction of the medium 100 relative to the head 4, so as to cover at least a portion of the medium 100. Of them, the first cover part 26 constitutes the first heating element 21, and the second cover part 27 constitutes the second heating element 22. The first cover part 26 and the second cover part 27, that is, the first heating element 21 and the second heating element 22 are formed in long shape in the direction of gravity along the platen 7. The cover members 25 are formed so as to cover at least a portion of the conveyance path 8 for conveying the medium 100, and the cover members 25 are configured such that at least a part of the portion covering the conveyance path 8 can expand and contract according to relative rotation of the first heating element 21 and the second heating element 22.

Specifically, the first cover part 26 is provided on a face of the first heating element 21 facing the medium 100, and the second cover part 27 is provided on a face of the second heating element 22 facing the medium 100. Both of the first cover part 26 and the second cover part 27 are formed by sheet-metal members, and are turned such that their plate thickness directions become close to the thickness direction of the medium 100, and are disposed so as to face the medium 100. Since the cover members 25 which are provided as described above are provided on the first heating element 21 and the second heating element 22 to which the hinge 23 is connected, it can be said that the hinge 23 is connected to the cover members 25. In this way, the first cover part 26 and the second cover part 27 are connected by the hinge 23 disposed therebetween, so as to be able to relatively rotate with respect to each other, and at least one of them is configured to be able to retreat from a position for covering the conveyance path 8 by relatively rotating by the hinge 23.

Also, in the first heating element 21, air blowers 40 are provided so as to blow air to a space between the dryer 20 and the medium 100, and the air blowers 40 are stored in the first heating element 21. Each air blower 40 has an air outlet 61 formed in a surface facing the medium 100, that is, a surface facing the platen 7, and can blow air from the air outlet 61 to the space between the dryer 20 and the medium 100. The air outlet 61 of each air blower 40 is formed in the vicinity of the upper end of a surface of the dryer 20 facing the medium 100. Specifically, the air outlets 61 are formed at the top of the first heating element 21 in the direction of gravity, and are openings for blowing a drying air flow Fd (see FIG. 4) or preliminary air Ap (see FIG. 4) by air blowing fans 45 such that the drying air flow Fd is introduced into the gap between the platen 7 and the cover members 25.

The air blowers 40 which are formed as described above include: the air blowing fans 45 which are air blowers, and air-flow-direction changing wall parts 60 which are provided on the air flow path of the air blowing fans 45 and change the flow direction of air blown from the air blowing fans 45. Of them, the air blowing fans 45 are provided as drying-air-flow supply which cause the drying air flow Fd (see FIG. 4) for drying ink ejected on the medium 100 to flow between the medium 100 and the cover members 25. If electric power is supplied to the air blowing fans 45, the air blowing fans become able to operate to create wind inside the air blowers 40, thereby blowing the preliminary air Ap (see FIG. 4) which is the previous stage of the drying air flow Fd.

Also, the air-flow-direction changing wall parts 60 are provided as flow path changer for changing the flow direction of the preliminary air Ap which is the previous stage of the drying air flow Fd. Specifically, the air-flow-direction changing wall parts 60 are provided above the air blowing fans 45, such that the preliminary air Ap blown from the air blowing fans 45 can collide with the air-flow-direction changing wall parts 60, whereby the flow direction can be changed. In this way, the air-flow-direction changing wall parts 60 can change the flow direction of the preliminary air Ap blown upward from the air blowing fans 45, thereby directing the wind toward the air outlets 61. In other words, the air-flow-direction changing wall parts 60 direct air blown from the air blowing fans 45 downward, thereby directing the wind created in the air blowers 40 toward the air outlets 61, and send the wind out from the air outlets 61, thereby sending the wind as the drying air flow Fd toward the gap between the medium 100 and the cover members 25.

Also, in the dryer 20, at least one cord type heater 28 is provided as heater for heating air blown from the air blowing fans 45 or/and the cover members 25. The cord type heaters 28 are bonded to the opposite surfaces of the cover members 25 to their surfaces facing the medium 100, and are bonded to both of the first cover part 26 and the second cover part 27. The cord type heaters 28 which are bonded to the cover members 25 as described above can heat the cover members 25, thereby heating the drying air flow Fd blown toward the gap between the medium 100 and the cover members 25 by the air blowers 40.

In the printing apparatus 1, between the air outlets 61 which are formed at the dryer 20 and the head 4 which is provided in the printing apparatus main body 2, a partition plate 18 is provided to separate the air outlets 61 and the head 4. The partition plate 18 is provided in the printing apparatus main body 2 so as to be positioned above the platen 7 and on the downstream side from the head 4 in the conveyance direction of the medium 100. When the medium 100 is mounted on the platen 7 and is conveyed from the side of the head 4 to the side where the positioning roller 15 and the winding roller 12 are positioned, the medium is conveyed through the gap between the partition plate 18 and the platen 7.

Figure 3:
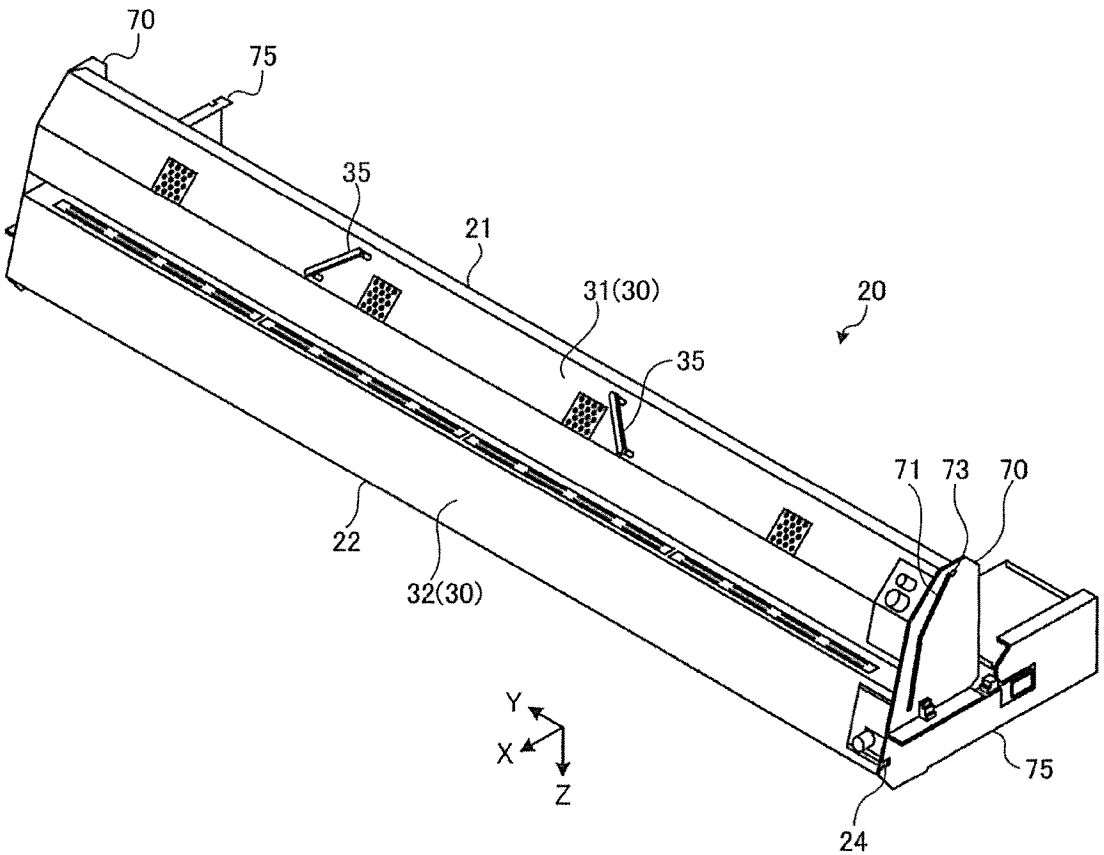
FIG. 3 is a perspective view of a dryer shown in FIG. 1.
Figure 4:
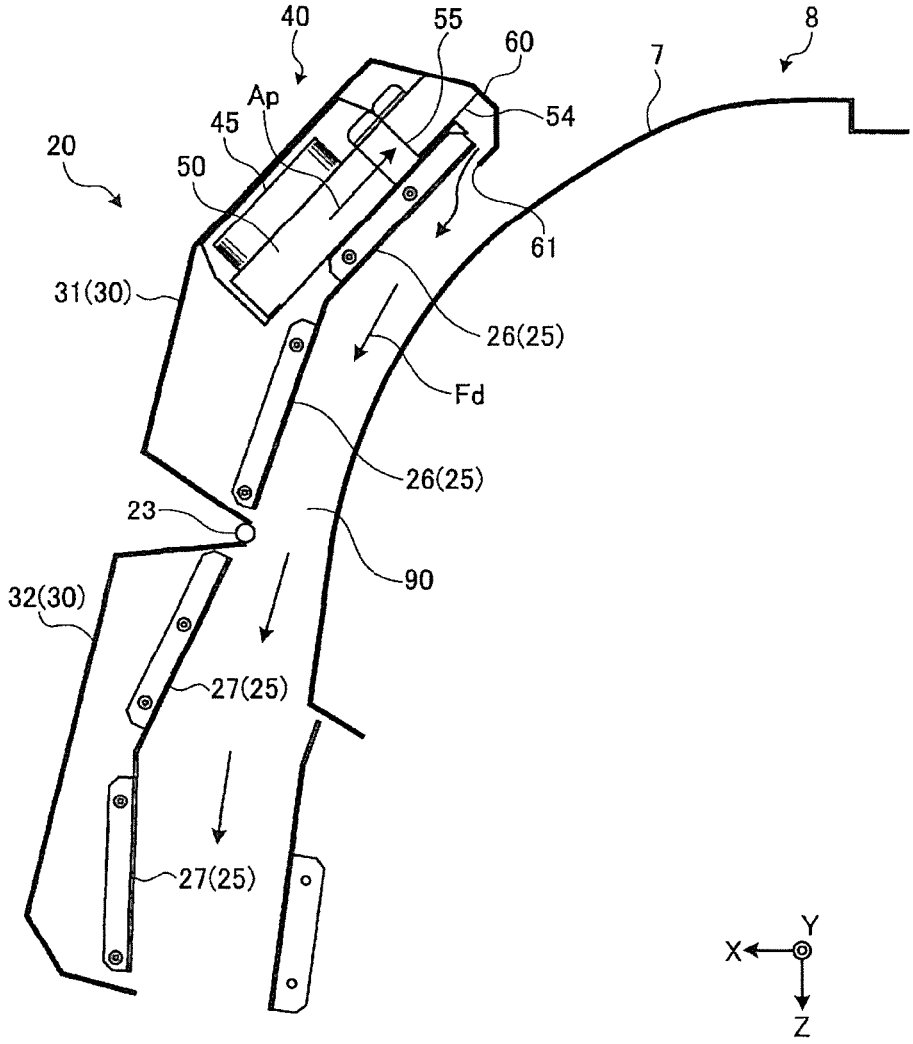
FIG. 4 is a cross-sectional view as the dryer shown in FIG. 3 is seen in a main scan direction.

FIG. 3 is a perspective view of the dryer shown in FIG. 1. FIG. 4 is a cross-sectional view as the dryer shown in FIG. 3 is seen in the main scan direction. The dryer 20 is assembled with the printing apparatus main body 2 by fixing members 75 which are disposed on both ends of the dryer 20 in the main scan direction. The fixing members 75 are provided on two portions on both sides of the dryer 20 in the main scan direction, and extend from both end portions of the dryer 20 toward the side where the printing apparatus main body 2 is positioned, as seen from the dryer 20.

In the dryer 20, at both end portions of the second heating element 22 in the main scan direction, rotation connection parts 24 are provided so as to be close to the lower end of the second heating element 22. The rotation connection parts are connected to the fixing members 75, so as to be rotatable. Since the rotation connection parts 24 are formed so as to protrude in the main scan direction, the second heating element 22 connected to the fixing members 75 by the rotation connection parts 24 is rotatable on the axial center of the rotation connection parts 24 extending in the main scan direction.

Also, on the portions of the fixing members 75 which are connected to the rotation connection parts 24, side plates 70 are attached. Like the fixing members 75, the side plates 70 are provided at two portions on both sides of the dryer 20 in the main scan direction. On the first heating element 21, engagement members 73 are provided so as to be close to the upper ends of both end portions of the first heating element 21 in the main scan direction and protrude in the main scan direction, and in the side plates 70, folding/unfolding guides 71 for inserting the engagement members 73 are formed. The folding/unfolding guides 71 are formed, in a slit shape, as guide parts for guiding the engagement members 73, thereby guiding the first heating element 21 during rotation, when the first heating element 21 relatively rotates with respect to the second heating element 22 by the hinge 23.

Also, the first heating element 21 and the second heating element 22 have heating element covers 30 as their covers. The heating element covers 30 are provided on the opposite faces of the first heating element 21 and the second heating element 22 to their faces where the cover members 25 are provided. Specifically, on the first heating element 21, a first heating element cover 31 is provided as a heating element cover 30, and on the second heating element 22, a second heating element cover 32 is provided as a heating element cover 30.

The first heating element cover 31 and the second heating element cover 32 are formed so as to cover the opposite faces of the first heating element 21 and the second heating element 22 to their faces where the cover members 25 are provided, respectively. On the first heating element cover 31 of the first heating element cover 31 and the second heating element cover 32, handles 35 are provided such that a user of the printing apparatus 1 can hold them to rotate the first heating element 21 and the second heating element 22. The handles 35 are provided at two portions positioned on the upper half of the first heating element cover 31, and the two handles 35 are provided almost in an inverted V shape so as to be symmetric with respect to the center of the first heating element cover 31 in the main scan direction. In other words, the two handles 35 are positioned such that the user can easily hold them with both hands.

Also, the air blower 40 are disposed inside the first heating element cover 31, so as to be close to the upper end of the inside of a space which is defined by the first heating element cover 31 and the first cover part 26. The upper end portion of the first heating element cover 31 is provided as the air-flow-direction changing wall parts 60. Between the air blowing fans 45 and the air-flow-direction changing wall parts 60, widening ducts 50 and current plates 55 (to be described below) are provided.

Also, the upper end portion of the first heating element cover 31 is formed to be curved to the side where the first cover part 26 is positioned and be closer to the platen 7 than the first cover part 26 is. Therefore, on a face of the first heating element 21 on a side of the first cover part 26, between the first cover part 26 and a portion of the first heating element cover 31 closer to the platen 7 than the first cover part 26 is, a gap is formed. This gap is formed as the air outlets 61. Since the air outlets 61 are formed by the first cover part 26 and a portion of the first heating element cover 31 near its upper end as described above, the air outlets 61 are open substantially downward, and connect the inside and outside of the first heating element 21.

In the dryer 20 having the air outlets 61 formed on the face positioned on a side of the platen 7 as described above, a space which is defined by the platen 7 and a face of the dryer where the cover members 25 are positioned is formed as an air flow path 90 of a wind sent out from the air outlets 61.

Figure 5:
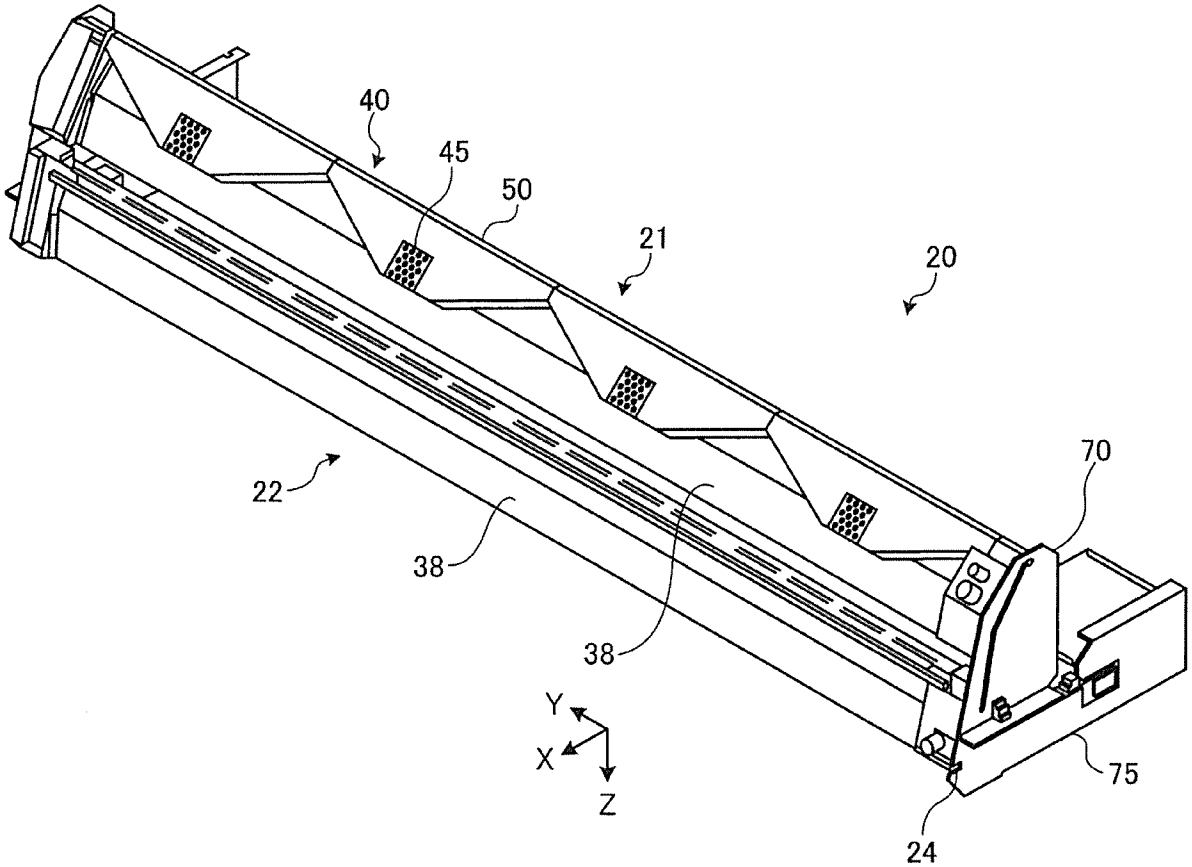
FIG. 5 is a perspective view illustrating the dryer shown in FIG. 3 without heating element covers.

FIG. 5 is a perspective view illustrating the dryer shown in FIG. 3 without the heating element covers. Inside the first heating element 21 and the second heating element 22, at portions closer to the heating element covers 30 than to the cover members 25, heat insulating materials 38 are disposed. The heat insulating materials 38 are formed such that heat conductivity becomes low, and are disposed inside the first heating element 21 and the second heating element 22 so as to cover the whole cover members 25.

Also, the plurality of air blower 40 is provided in a line in the main scan direction inside the first heating element 21, and each air blower 40 includes an air blowing fan 45 and a widening duct 50. Each widening duct 50 is formed in a fan shape for spreading the preliminary air Ap, blown from the air blowing fan 45, in a direction perpendicular to the movement direction of the medium 100, that is, the main scan direction. Specifically, an air blowing fan 45 is attached to each widening duct 50, and each widening duct 50 is formed in a fan shape which widens in the main scan direction as it goes from a position where the air blowing fan 45 is disposed toward the upper end side of the first heating element 21. Since each widening duct 50 is formed in a fan shape as described, the plurality of widening ducts 50 are disposed inside the first heating element 21 so as to be continuous in the main scan direction.

Figure 6:
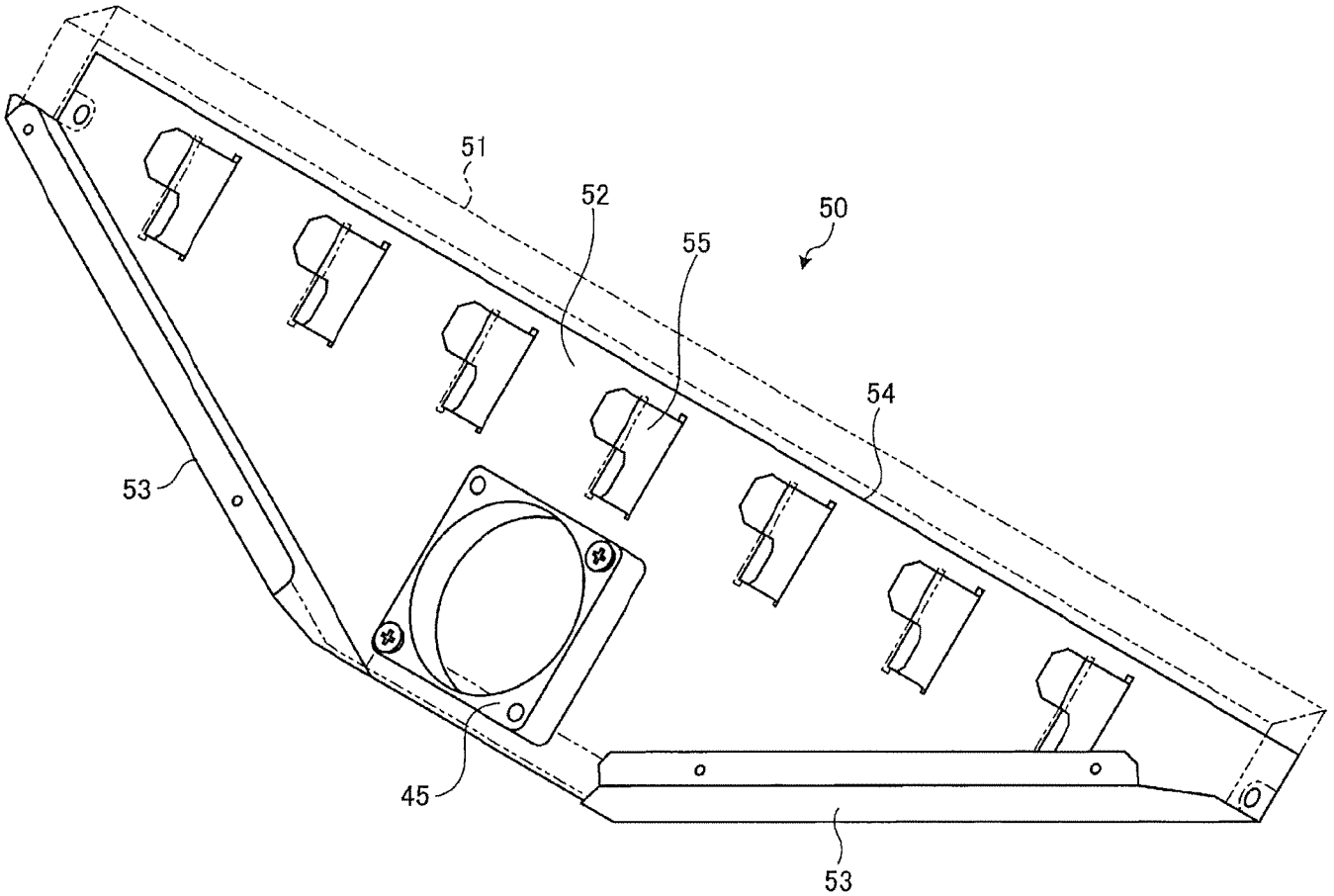
FIG. 6 is a perspective view of a widening duct shown in FIG. 5.

FIG. 6 is a perspective view of a widening duct shown in FIG. 5. The widening duct 50 is formed by assembling a fan side member 51 to be positioned on a side of the first heating element cover 31 and an air outlet side member 52 to be positioned on a side of the first cover part 26. The fan side member 51 and the air outlet side member 52 are formed in fan shapes or trapezoidal shapes, and their shapes as they are seen substantially in the sub scan direction are similar to each other. The fan side member 51 and the air outlet side member 52 are assembled, whereby the widening duct 50 is formed so as to have an internal space. Also, at both ends of a portion of the widening duct 50 widening in the main scan direction, inclined surfaces 53 are provided so as to stand in the thickness direction of the first heating element 21, and the internal space of the widening duct 50 is closed with respect to the main scan direction by the inclined surfaces.

Meanwhile, as for the heights of the trapezoidal shapes which are the shapes of the fan side member 51 and the air outlet side member 52, the height of the air outlet side member 52 is lower than the height of the fan side member 51. Also, in an end portion of the fan side member 51 on the wider side of the widening duct 50, a wall surface is formed so as to stand in the thickness direction of the first heating element 21. A portion which is defined by an end portion of the air outlet side member 52 on the wider side and a wall surface provided at the end portion on the wider side of the fan side member 51 so as to stand in the thickness direction of the first heating element 21 becomes a widening-duct opening 54 which is an opening of the widening duct 50. The internal space of the widening duct 50 is connected to the outside of the widening duct 50 through the widening-duct opening 54. The widening duct 50 is attached to the first heating element 21, such that the widening-duct opening 54 is positioned in the vicinity of the air outlet 61 and the widening-duct opening 54 and the air outlet 61 are connected. An air blowing fan 45 is attached to the fan side member 51 so as to be able to blow air to the internal space of the widening duct 50.

Also, the wall surfaces provided at the end portions of the fan side members 51 of the widening ducts 50 on the wider side so as to stand in the thickness direction of the first heating element 21, and the upper end portion of the first heating element cover 31 constitute the air-flow-direction changing wall parts 60. To this end, the widening-duct openings 54 are formed adjacent to the air-flow-direction changing wall parts 60.

Inside each widening duct 50 which is formed as described above, in the vicinity of the wider end portion, that is, in the vicinity of the widening-duct opening 54, a plurality of current plates 55 extending in the flow direction of the preliminary air Ap blown from the air blowing fan 45 is provided side by side in the width direction. The current plates 55 are provided over a portion between the fan side member 51 and the air outlet side member 52 such that the thickness direction is aligned with the widening direction of the widening duct 50 and the width direction is aligned with the height direction of the trapezoidal shapes which are the shapes of the fan side member 51 and the air outlet side member 52.

Figure 7:
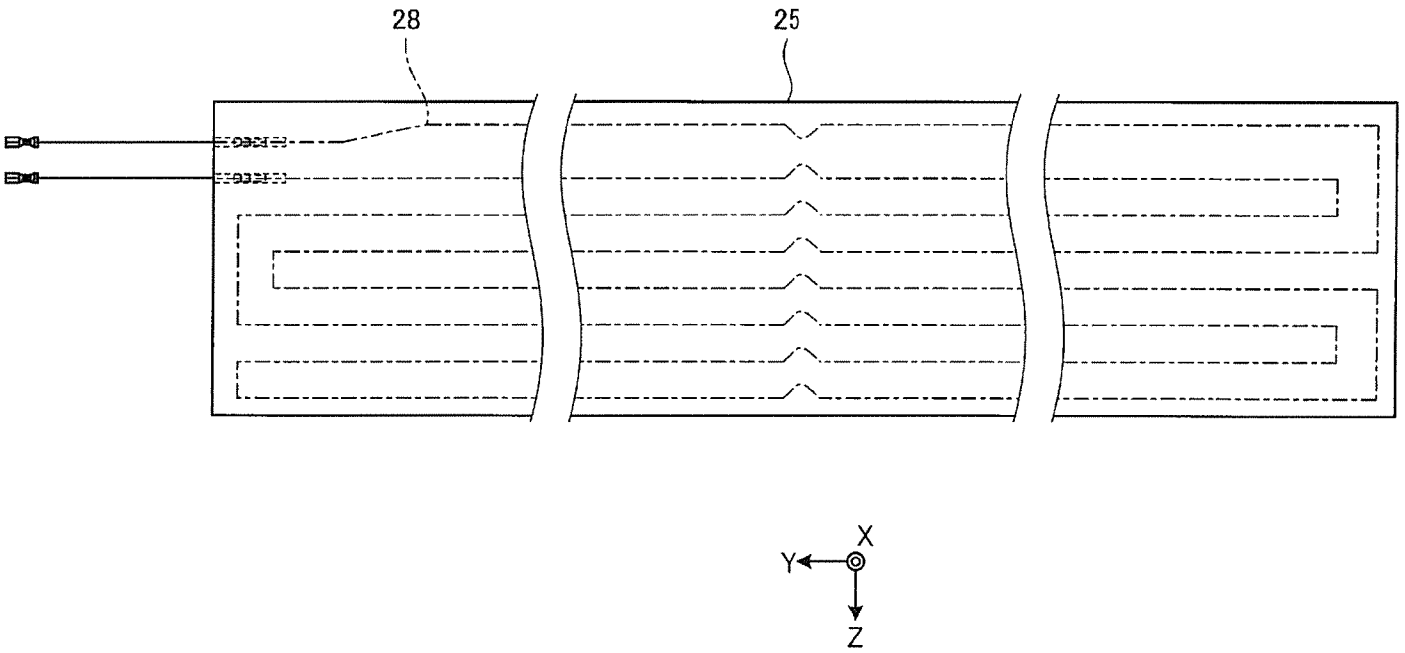
FIG. 7 is a plan view of a cover member shown in FIG. 4.

FIG. 7 is a plan view of a cover member shown in FIG. 4. The cord type heaters 28 which are bonded to the cover members 25 are provided throughout the width direction of the medium 100 in the direction perpendicular to the movement direction of the medium 100. Specifically, the cord type heaters 28 are disposed along the main scan direction on the cover members 25 and are turned in the vicinities of the end portions of the cover members 25 in the main scan direction, such that portions along the main scan direction are disposed in parallel in an up and down direction. In this way, the cord type heaters 28 are disposed over the entire areas of the cover members 25, that is, the cord type heaters 28 are disposed over the entire areas of both of the first cover part 26 and the second cover part 27. Therefore, the cord type heaters 28 are stored in the first heating element 21 and the second heating element 22. Also, the air blower 40 which are stored in the first heating element 21 are disposed on the opposite side of the cord type heater 28 to the platen 7 so as to overlap the cord type heater 28.

The dryer 20 and the printing apparatus main body 2 which are configured as described above are controlled by a control unit (not shown) which is provided in the printing apparatus main body 2. The control unit is a unit for controlling each unit of the printing apparatus 1, and includes a central processing unit (CPU) which functions as a controller for performing various processes, a random access memory (RAM) and a read only memory (ROM) for storing a variety of information, and so on. The control unit performs control on printing of the printing apparatus main body 2 on the medium 100 and an operation of the dryer 20 for drying the printed medium 100.

The printing apparatus 1 according to the present embodiment is configured as described above, and the effects of the printing apparatus will be described below. On the occasion of performing printing on the medium 100, the medium 100 wound around the medium feeding roller 13 like a roll is drawn from the medium feeding roller 13, and passes through the gap between the head 4 and the platen 7. In a state where the medium 100 has been disposed between the medium feeding roller 13 and the winding roller 12, the printing apparatus 1 performs printing.

Figure 8:
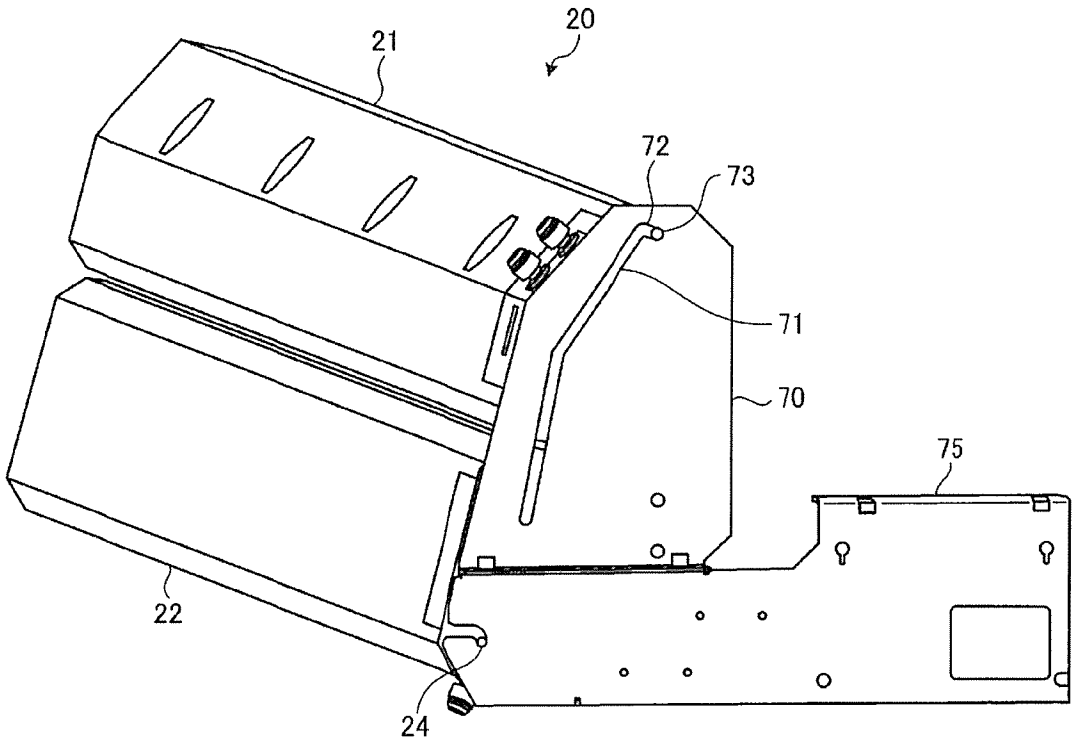
FIG. 8 is a perspective view illustrating the state of the dryer when the printing apparatus performs printing.

FIG. 8 is a perspective view illustrating the state of the dryer when the printing apparatus performs printing. Also, on the occasion of performing printing using the printing apparatus 1, the dryer 20 in which the first heating element 21 and the second heating element 22 can relatively rotate is controlled, such that the first heating element 21 and the second heating element 22 are unfolded, whereby the cover members 25 of them face the medium 100. Specifically, the engagement members 73 provided on the first heating element 21 are positioned at engagement portions 72 which are positions in the folding/unfolding guides 71 formed in the side plates 70 and where the engagement members 73 are inserted to unfold the first heating element 21 and the second heating element 22. As a result, the dryer 20 becomes a state where the first heating element 21 and the second heating element 22 are unfolded and the first cover part 26 and the second cover part 27 face the medium 100.

The printing apparatus 1 performs printing on the medium 100 by ejecting ink from the head 4 onto the medium 100. At this time, the control unit moves the head 4 along the Y bar 5, thereby moving the head 4 back and forth in the main scan direction. Therefore, the head 4 ejects ink onto the medium 100 placed on the platen 7 while reciprocating in the main scan direction, such that the ink lands on the medium 100, thereby performing printing on the medium 100.

After printing is performed on a predetermined range in the main scan direction by the head 4, the control unit controls the driver 10, thereby operating the drive roller 11 and the winding roller 12 to move the medium 100 from a side of the medium feeding roller 13 toward a side of the winding roller 12 by a predetermined movement amount. In other words, the control unit performs control such that the medium 100 moves with respect to the head 4 in the sub scan direction by the predetermined movement amount. After the medium 100 moves, the control unit re-performs control such that the head 4 is moved in the main scan direction while ink is ejected from the head 4, whereby printing is performed on the predetermined range in the main scan direction. The printing apparatus 1 repeats the above described operation, thereby performing printing on the medium 100.

Since the printing apparatus 1 performs printing while conveying the medium 100 in the sub scan direction as described above, the medium 100 after landing of ink is conveyed to a position facing the dryer 20. During printing of the printing apparatus 1, in the dryer 20, while the cord type heaters 28 generate heat, the air blowing fans 45 create wind by the preliminary air Ap. In the case where the cord type heaters 28 generate heat, the heat generated by the cord type heaters 28 is transferred to the cover members 25, and the transferred heat is transferred throughout the cover members 25 composed of a metal material. Therefore, the temperatures of the whole cover members 25 rise.

Also, the flow direction of the preliminary air Ap blown from the air blowing fans 45 by the air blowing fans 45 is changed by the air-flow-direction changing wall parts 60, such that the preliminary air flows toward the gap between the medium 100 and the cover members 25. Specifically, the preliminary air Ap blown from the air blowing fan 45 flows into the widening ducts 50. Since the widening ducts 50 have the widening-duct openings 54 formed at their end portions on the wider side, the preliminary air Ap entering the widening ducts 50 flows toward the widening-duct openings 54, that is, toward the end portions on the wider side.

Since the plurality of current plates 55 is disposed inside the widening ducts 50, the preliminary air Ap flowing in the widening ducts 50 toward the openings 54 positioned on the wider side passes through the current plates 55, thereby being rectified. In other words, the preliminary air Ap flowing in the widening ducts 50 is rectified by the current plates 55, whereby turbulence of the flow is reduced, and in this state, the preliminary air smoothly flows in the widening ducts 50 toward the end portions.

If the preliminary air Ap flows in the widening ducts 50 as described above, thereby reaching a side of the widening-duct opening 54 positioned on the wider side of the widening ducts 50, the preliminary air is sent out from the widening ducts 50 through the widening-duct openings 54 positioned near the air-flow-direction changing wall part 60.

The preliminary air Ap flowing from the widening ducts 50 to the outside of the widening ducts 50 through the widening-duct openings 54 is guided to the air-flow-direction changing wall parts 60 of the first heating element cover 31 while flowing toward the air outlets 61. The air flowing toward the air outlets 61 passes through the air outlets 61, thereby flowing from the inside of the first heating element 21 to the outside of the first heating element 21. Since the air outlets 61 are open substantially downward, the air flowing out from the air outlets 61 flows downward. Therefore, the preliminary air Ap flowing out from the air outlet 61 flows, as the drying air flow Fd for drying ink ejected on the medium 100, toward the gap between the medium 100 and the cover members 25.

Since the air blowing fans 45 blow air only inside the widening ducts 50, whereby the preliminary air Ap in the widening ducts 50 is sent out from the widening-duct openings 54, the flow direction of all of the air which is sent from the air blowing fans 45 toward the gap between the medium 100 and the cover members 25 is changed by the air-flow-direction changing wall parts 60. In other words, the flow direction of the preliminary air Ap sent from the air blowing fans 45 is changed by the air-flow-direction changing wall part 60, whereby the preliminary air flows as the drying air flow Fd into the air flow path 90 between the medium 100 and the cover members 25.

As described above, since the temperatures of the cover members 25 which constitute the air flow path 90 together with the medium 100 are increased by heat generation of the cord type heaters 28, the temperature of the drying air flow Fd which flows in the air flow path 90 also rises due to radiant heat from the cover members 25. In the air flow path 90, the air blown from the air blowing fans 45 is sequentially sent downward from the air outlets 61 while air heated by radiant heat from the cover members 25 tends to move upward. Therefore, the drying air flow Fd in the air flow path 90 is agitated while being heated.

During printing of the printing apparatus 1, after ink ejected from the head 4 lands on the medium 100, the medium is conveyed from the top of the platen 7 toward the winding roller 12 by the driver 10, thereby moving into the air flow path 90. Ink on the medium 100 moving into the air flow path 90 after landing of ink ejected from the head 4 may be wet still. However, since the drying air flow Fd in the air flow path 90 has been heated and agitated, the whole of a portion of the medium 100 which is positioned in the air flow path 90 is heated by the drying air flow Fd having been heated and agitated while steam arising from the ink is removed. Therefore, if ink is ejected from the head 4 and lands on a portion of the medium 100, and the portion of the medium 100 is positioned in the air flow path 90, the ink appropriately dries.

Also, most of air flowing from the air outlet 61 of the dryer 20 into the air flow path 90 flows downward. However, in some cases such as a case where the volume of air is large, the flow of the air may become turbulent, thereby flowing upward. In this case, it can be considered that a portion of the air flows toward the head 4 of the printing apparatus main body 2. Even in this case, since the printing apparatus main body 2 has the partition plate 18 which separates the air outlets 61 and the head 4, the air flowing toward the head 4 is blocked by the partition plate 18.

After ink on the medium 100 is dried by the drying air flow Fd flowing from the dryer 20 into the air flow path 90, the medium is sequentially conveyed by the driver 10, toward the winding roller 12 and is wound around the winding roller 12. When the printing apparatus 1 performs printing on the medium 100, as described above, printing is performed by the printing apparatus main body 2 while the medium 100 is conveyed, and ink on the medium 100 is dried by the dryer 20. In this way, printing is continuously performed on the roll-like medium 100.

Also, in the above described embodiment, air flowing into the air flow path 90 is heated by the heaters provided on the cover members 25. However, the heater is not limited to the heaters provided on the cover members 25, and a method of directly heating an air flow, such as a method of heating an air flow by a heater before or after the direction of the air flow is changed by the air-flow-direction changing wall parts 60 can be applied.

Figure 9:
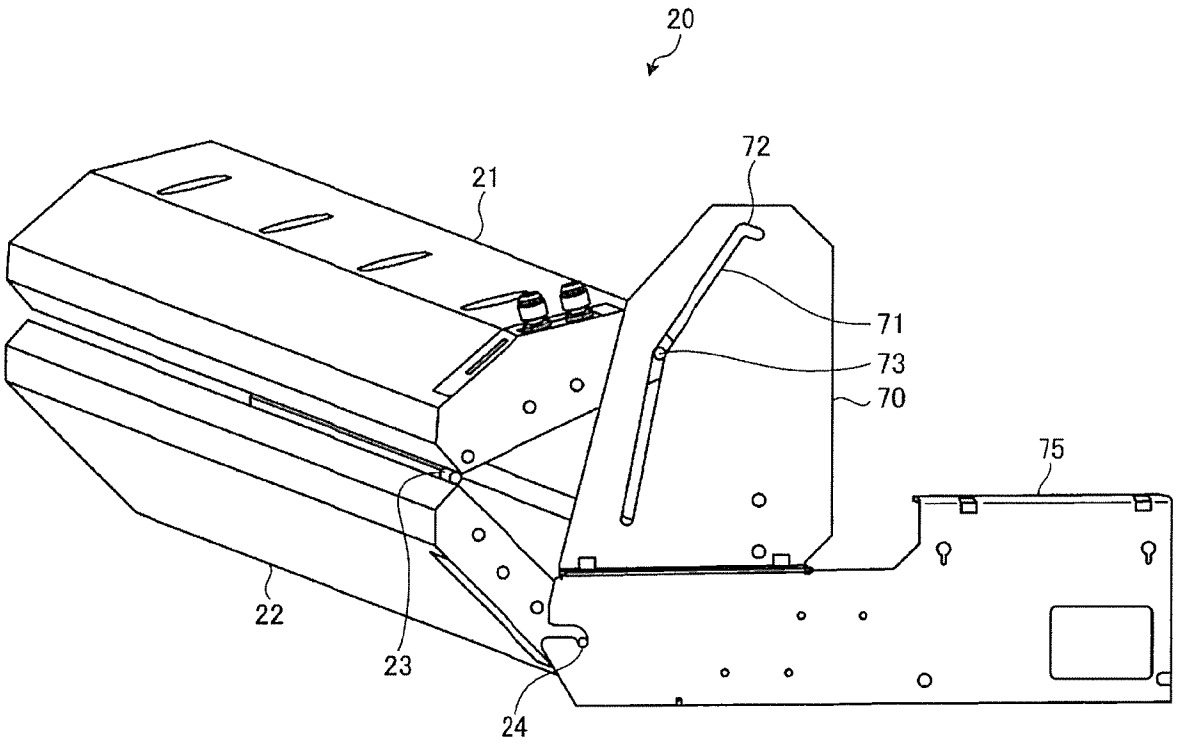
FIG. 9 is a perspective view illustrating the dryer in a case of folding the dryer shown in FIG. 8.

In a case where printing of the printing apparatus 1 has finished, the dryer 20 is folded if necessary. FIG. 9 is a perspective view illustrating the dryer in a case of folding the dryer shown in FIG. 8. In the case of folding the dryer 20, the user holds the handles 35 provided on the first heating element 21 and draws them up, thereby relatively rotating the first heating element 21 with respect to the second heating element 22 such that the engagement members 73 of the first heating element 21 engaged with the engagement portions 72 formed in the folding/unfolding guides 71 of the side plates 70 move along the folding/unfolding guides 71.

Specifically, the engagement members 73 are moved downward along the folding/unfolding guides 71, whereby the first cover part 26 and the second cover part 27 rotate so as to be almost horizontal. In this case, the second cover part 27 relatively rotates on the rotation connection parts 24 with respect to the fixing members 75, and the first cover part 26 relatively rotates with respect to the second cover part 27 by the hinge 23. In this way, the first cover part 26 and the second cover part 27 rotate toward each other so as to come close.

Figure 10:
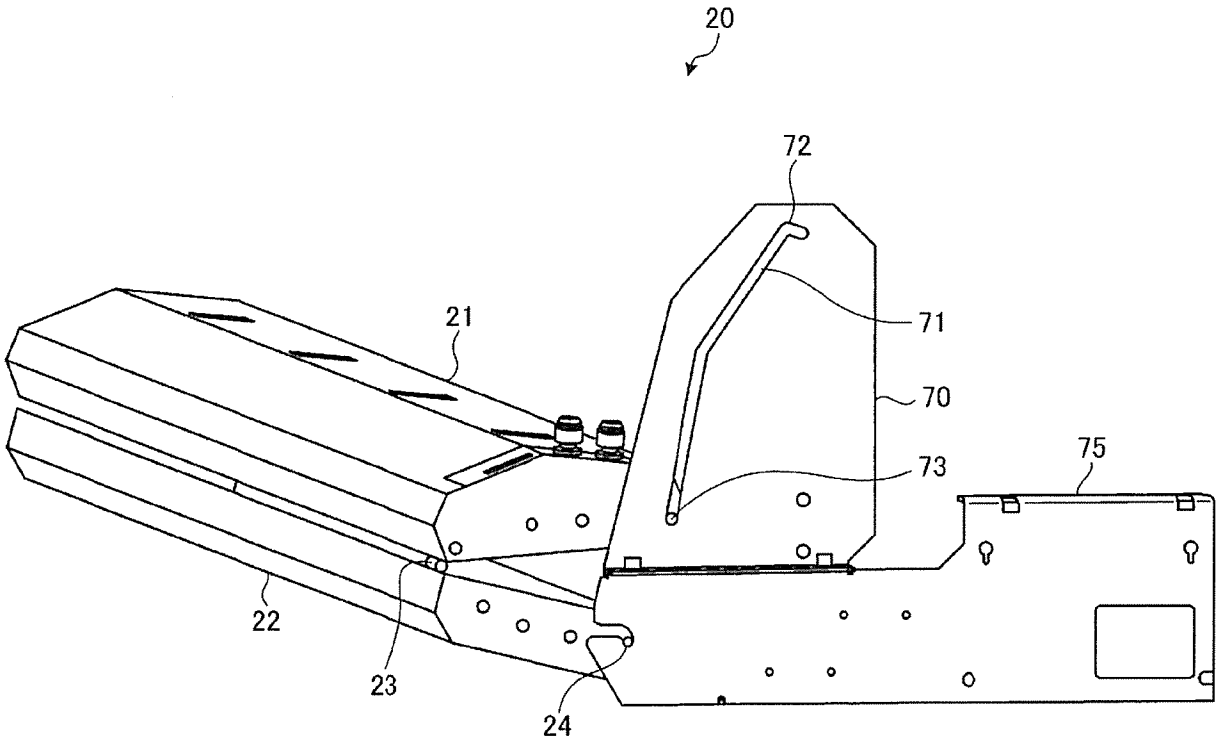
FIG. 10 is a perspective view illustrating the dryer shown in FIG. 9 in a state where the dryer is folded.

FIG. 10 is a perspective view illustrating the dryer shown in FIG. 9 in a state where the dryer is folded. If the first heating element 21 and the second heating element 22 are relatively rotated, whereby the engagement members 73 provided on the first heating element 21 reach the lower ends of the folding/unfolding guides 71 formed in the side plates 70, the engagement members 73 cannot be moved downward from the lower ends of the folding/unfolding guides. This state of the dryer 20 is the state where the first heating element 21 and the second heating element 22 are folded. The first heating element 21 and the second heating element 22 which can be folded as described above are configured by connecting them by the hinge 23 such that the cover members 25 do not protrude into the conveyance path 8 during expansion or contraction of the cover members 25. Therefore, the first heating element 21 and the second heating element 22 relatively rotate such that, when the first heating element 21 and the second heating element 22 are folded, thereby contracting in the conveyance direction of the medium 100, their end portion sides connected to the hinge 23 move away from the platen 7. Therefore, in a state where the first heating element 21 and the second heating element 22 are folded, since the first cover part 26 faces substantially downward, and the second cover part 27 faces substantially upward, the first cover part 26 and the second cover part 27 substantially face each other. In other words, in the dryer 20, when the first heating element 21 and the second heating element 22 are folded, the first cover part 26 and the second cover part 27 are positioned on the inner side.

Figure 11:
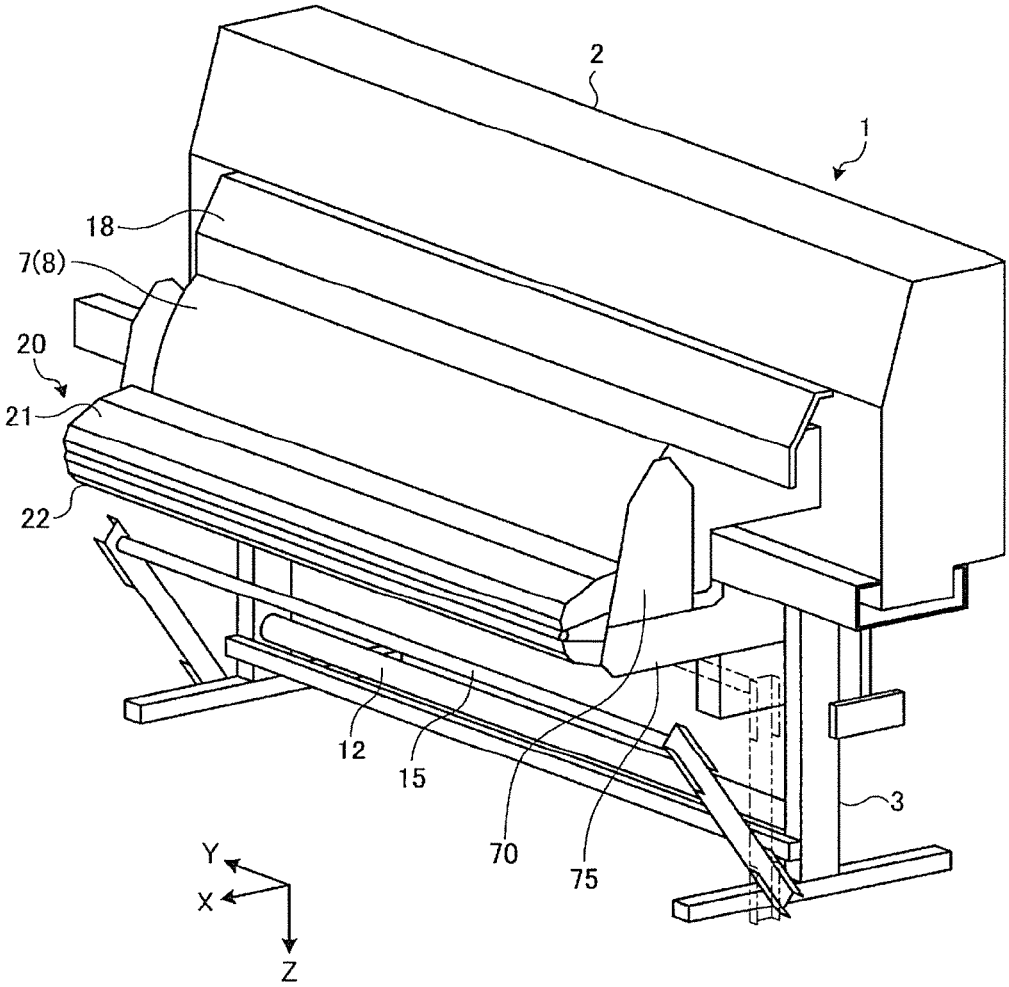
FIG. 11 is a perspective view illustrating the printing apparatus in a state where the dryer is folded.

FIG. 11 is a perspective view illustrating the printing apparatus in a state where the dryer is folded. In a case where the dryer 20 is folded, in the printing apparatus 1, a portion of the platen 7 of the printing apparatus main body 2 positioned on a side of the dryer 20 is exposed. Therefore, in the case where the dryer 20 is folded, it is easy to perform maintenance such as setting of the medium 100 in the printing apparatus main body 2.

In the printing apparatus 1 according to the above described embodiment, since the flow direction of the preliminary air Ap blown from the air blowing fans 45 is changed by the air-flow-direction changing wall parts 60 provided at the dryer 20, and then the preliminary air flows, as the drying air flow Fd, toward the gap between the medium 100 and the cover members 25, it is possible to suppress air blown from the air blowing fans 45 from straightly flowing. Therefore, it is possible to suppress an uneven air flow from being created on the medium 100, and it is possible to suppress cockling from occurring. As a result, it is possible to dry ink on the medium 100 while suppressing cockling from occurring. Also, since heating of at least one of the drying air flow Fd and the preliminary air Ap by the cord type heaters 28 and an air flow with little unevenness are used to raise the temperature of the air flow path 90, it is possible to easily perform temperature management during drying of ink.

Also, since the air blowing fans 45 blow the preliminary air Ap, whereby the preliminary air Ap collides with the air-flow-direction changing wall parts 60, whereby the flow direction is changed such that the preliminary air is used as the drying air flow Fd, it is possible to easily create the drying air flow Fd to flow toward the gap between the medium 100 and the cover members 25. As a result, it is possible to easily dry ink on the medium 100.

Also, since the plurality of current plates 55 is provided inside the widening ducts 50, it is possible to evenly send wind out from the widening-duct openings 54, and it is possible to evenly send wind into the air flow path 90. As a result, the volume of air flow is uniformized, and it is possible to suppress unevenness in heating which is performed by the cord type heaters 28, and it is possible to suppress ink from being unevenly dried.

Also, since the air-flow-direction changing wall parts 60 direct the preliminary air Ap, blown from the air blowing fans 45, downward, thereby sending the preliminary air as the drying air flow Fd toward the gap between the medium 100 and the cover members 25, in a case where air is heated by the cord type heaters 28, thereby flowing upward, it is possible to direct the flow of air downward. As a result, it is possible to make warm air stay between the cover members 25 and the medium 100, and it is possible to improve drying efficiency. Also, since air blown from the air blowing fans 45 is directed downward, it is possible to make it difficult for heat generated by the cord type heaters 28 to be transferred to the head 4. Therefore, it is possible to reduce adverse effects such as poor ink ejection attributable to drying of nozzles.

Also, since the cord type heaters 28 heat the cover members 25, thereby heating the drying air flow Fd in the air flow path 90, it is possible to perform temperature management by detecting the temperatures of the cover members 25. Therefore, it is possible to improve the reliability of temperature management. Also, in a case of heating the drying air flow Fd in the air flow path 90, the cover members 25 are also heated. Therefore, it is possible to improve heating efficiency during heating of the drying air flow Fd. Also, since the inexpensive cord type heaters 28 are used as heater, it is possible to suppress the manufacturing cost. Further, since the cord type heaters 28 are bonded to the cover members 25, it is possible to thin the heating element covers 30 for covering the cord type heaters 28, and it is possible to make the whole dryer 20 compact.

Also, since the cord type heaters 28 are provided throughout the width direction of the medium 100 in the main scan direction, it is possible to suppress a reduction in temperature at joints of heaters. In other words, for example, unlike in a case of using glass tube heaters or sheath heaters as heater, it is possible to suppress a reduction in temperature at joints. As a result, it is possible to more surely and evenly heat air in the air flow path 90.

Also, since the direction of the whole of the drying air flow Fd which is sent from the air blowing fans 45 toward the gap between the medium 100 and the cover members 25 is changed by the air-flow-direction changing wall parts 60, whereby unevenness of the air flow is reduced, it is possible to suppress a drying air flow Fd having been unevenly heated from coming into contact with the medium 100. As a result, it is possible to more surely suppress cockling attributable to uneven drying or a variation in temperature.

Also, since the partition plate 18 is provided between the air outlet 61 and the head 4, it is possible to suppress a flow of heated air from reaching the head 4, thereby suppressing the heated air from drying ink on the ejection ports of the head 4. As a result, printing failures are prevented from being caused by drying of ink on the ejection ports of the head 4, and it is possible to dry ink on the medium 100.

Also, since the first heating element 21 and the second heating element 22 of the dryer 20 are connected so as to be able to relatively rotate, it is possible to fold the first heating element 21 and the second heating element 22 on the occasion of setting the medium 100, and to unfold the first heating element 21 and the second heating element 22 on the occasion of starting printing. As a result, it is possible to suppress ease of setting of the medium 100 from being damaged, and provide the cover members 25 at positions facing the medium 100. Also, even in a case where the medium 100 is jammed or a trouble occurs in the dryer 20, if necessary, it is possible to unfold and fold the first heating element 21 and the second heating element 22, whereby it is possible to handle those troubles. As a result, it is possible to improve maintainability.

Also, the cord type heaters 28 and the air blowing fans 45 are stored inside the first heating element 21 which is configured using the first cover part 26, it is possible to improve heating efficiency due to heat insulating effect while saving space. Therefore, it is possible to evenly heat the space between the cover members 25 and the medium 100, and it is possible to suppress temperature unevenness. As a result, it is possible to dry ink on the medium 100 while suppressing cockling from occurring.

Also, since the air blowing fans 45 are provided at positions on the opposite sides of the cord type heaters 28 to the platen 7 so as to overlap the cord type heaters 28, it is possible to suppress the air blowing fans 45 from protruding outward from the area where the cord type heaters 28 are provided, thereby suppressing the air blowing fans from occupying a large space. As a result, it is possible to save space.

Also, since the drying air flow Fd or the preliminary air Ap is sent from the air outlets 61 formed at the top of the first heating element 21, it is possible to suppress the heated drying air flow Fd positioned between the platen 7 and the cover members 25 from exiting from the upper side in the direction of gravity. In other words, since the heated drying air flow Fd tends to move upward, but is sent downward from the air outlets 61 formed at the top of the first heating element 21, it is possible to suppress the drying air flow Fd from exiting upward from the gap between the platen 7 and the cover members 25. As a result, it becomes easy to hold the heated drying air flow Fd between the platen 7 and the cover members 25, and it is possible to further improve the heating efficiency.

Modifications

Also, in the printing apparatus 1 according to the above described embodiment, if air is blown from the air blowing fans 45 toward the gap between the cover members 25 and the medium 100, and enters the gap, the air is heated by the cord type heaters 28 with the cover members 25 interposed between. However, air may be heated before being sent into the gap between the cover members 25 and the medium 100. For example, cord type heaters 28 may be disposed inside the widening ducts 50. In this case, air heated in the widening ducts 50 may be sent out from the air outlets 61 and flow into the gap between the cover members 25 and the medium 100. In a case where air is directed substantially downward by the air-flow-direction changing wall parts 60 and then flows into the gap between the cover members 25 and the medium 100, the heating timing may be before or after the air enters the gap between the cover members and the medium.

Figure 12:
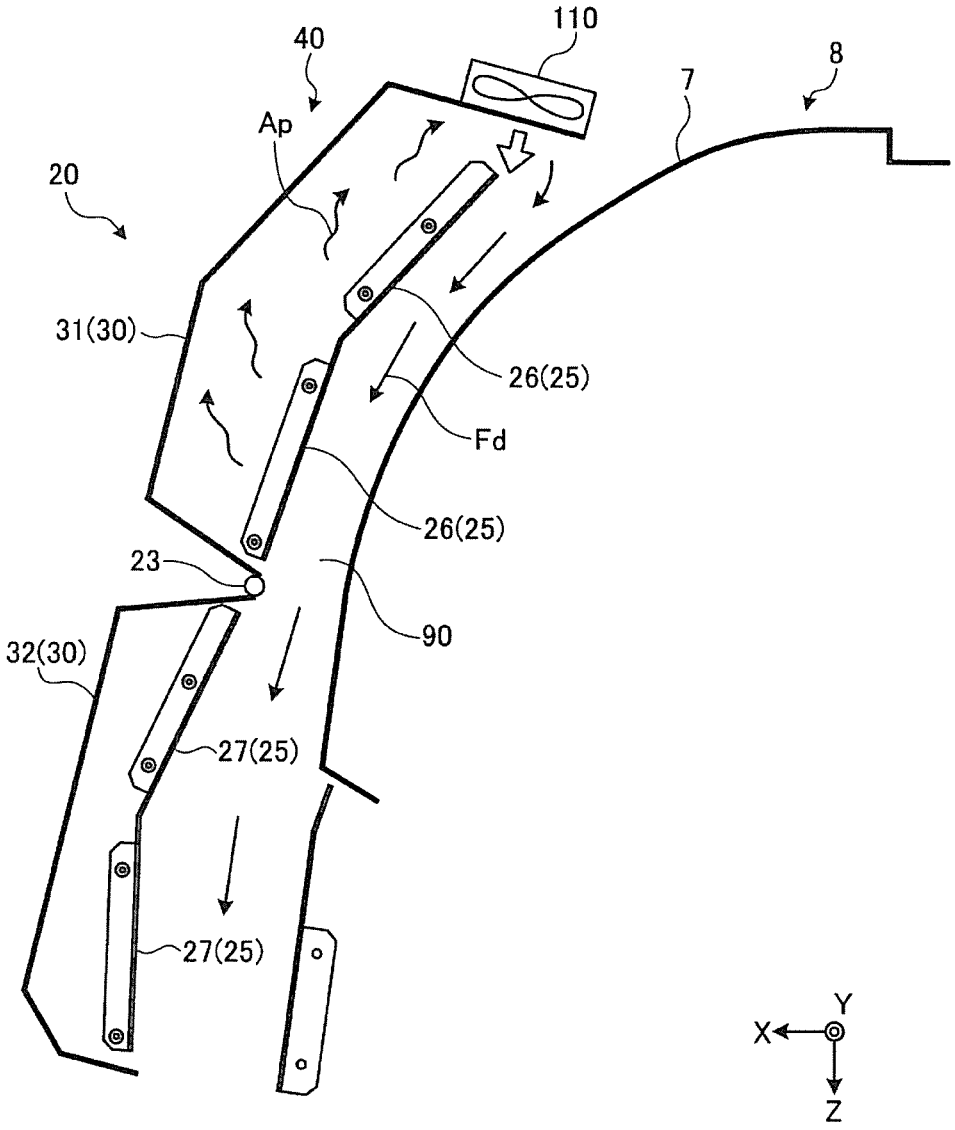
FIG. 12 is a view for explaining a case of using air blowing fans as flow path changer, as a modification of the printing apparatus according to the embodiment.

Also, in the printing apparatus 1 according to the above described embodiment, the air-flow-direction changing wall parts 60 are used as the flow path changer for changing the flow direction of the preliminary air Ap. However, as the flow path changer, devices other than the air-flow-direction changing wall parts 60 may be used. FIG. 12 is a view for explaining a case of using air blowing fans as flow path changer, as a modification of the printing apparatus according to the embodiment. For example, air blowing fans 110 which are air blower may be provided on the upper side of the first cover part 26 as shown in FIG. 12, and be used as flow path changer. In this case, the air blowing fans 110 are provided not only as drying-air-flow supply for sending the drying air flow Fd into the gap between the medium 100 and the cover members 25 but also as flow path changer. Specifically, the air blowing fans 110 are disposed so as to be able to send air from the above of the air flow path 90 between the medium 100 and the cover members 25 into the air flow path 90. In this case, the air blowing fans 110 are disposed such that, if the preliminary air Ap positioned on the opposite side of the cover members 25 to the medium 100 is heated, the preliminary air ascends toward the air blowing faces of the air blowing fans 110.

In this case, if the preliminary air Ap positioned on the opposite side of the cover members 25 to the medium 100 is heated by the cord type heaters 28 provided on the cover members 25, the heated preliminary air Ap is sent into the gap between the medium 100 and the cover members 25 by the air blowing fans 110. In other words, the air blowing fans 110 change the flow direction of the heated preliminary air Ap, thereby sending the preliminary air Ap as the drying air flow Fd into the gap between the medium 100 and the cover members 25. If the drying air flow Fd enters the gap between the medium 100 and the cover members 25, the drying air flow in the gap is heated by the cord type heaters 28, whereby the temperature rises. Therefore, it is possible to easily send the drying air flow Fd toward the gap between the medium 100 and the cover members 25, and it is possible to easily dry ink on the medium 100 by the drying air flow Fd.

Figure 13:
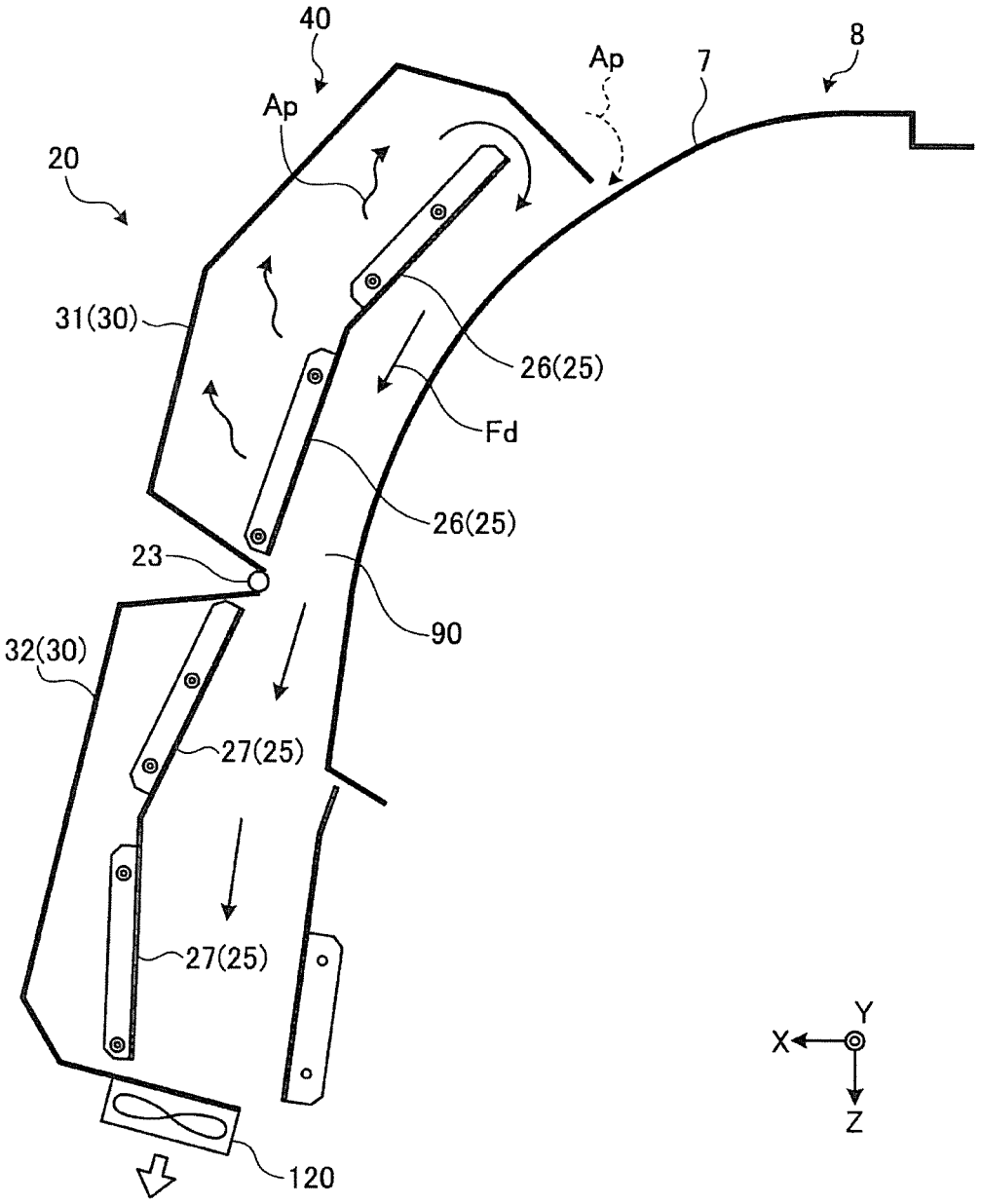
FIG. 13 is a view for explaining a case of using air intake fans as flow path changer, as another modification of the printing apparatus according to the embodiment.

Also, the flow path changer may suck air, thereby changing the flow direction of the preliminary air Ap. FIG. 13 is a view for explaining a case of using air intake fans as flow path changer, as another modification of the printing apparatus according to the embodiment. For example, air intake fans 120 which are air breathers may be provided below the second cover part 27 as shown in FIG. 13, and be used as flow path changer. In this case, the air intake fans 120 are provided not only as drying-air-flow supply for sending the drying air flow Fd into the gap between the medium 100 and the cover members 25 but also as flow path changer. Specifically, the air intake fans 120 are provided so as to be able to suck the drying air flow Fd in the air flow path 90 from below the air flow path 90 between the medium 100 and the cover members 25. In this case, it is preferable to form the upper end portion of the first heating element cover 31 so as to cover even the upper side of the first cover part 26 such that the preliminary air Ap positioned on the opposite side of the first cover part 26 to the medium 100 flows into the gap between the medium 100 and the cover members 25, without flowing upward.

If the air intake fans 120 are provided as described above, the air intake fans 120 can suck the drying air flow Fd in the air flow path 90 between the medium 100 and the cover members 25, from below of the air flow path 90, and send the drying air flow downward. In a case where the drying air flow Fd in the air flow path 90 flows downward, since a negative pressure is produced inside the air flow path 90, the preliminary air Ap positioned on the opposite side of the first cover part 26 to the medium 100 flows from the upper end side of the first cover part 26 into the air flow path 90 between the medium 100 and the cover members 25. In other words, the air intake fans 120 suck the drying air flow Fd in the gap between the medium 100 and the cover members 25, thereby changing the flow direction of the preliminary air Ap positioned on the opposite side of the cover members 25 to the medium 100, such that the preliminary air flows as the drying air flow Fd into the gap between the medium 100 and the cover members 25. Since the preliminary air Ap is heated by the cord type heaters 28 disposed on the cover members 25, whereby its temperature rises, the temperature of the drying air flow Fd to flow into the gap between the medium 100 and the cover members 25 also rises. Also, the drying air flow Fd in the gap between the medium 100 and the cover members 25 is heated by the cord type heaters 28, whereby its temperature rises. Therefore, it is possible to easily send the drying air flow Fd toward the gap between the medium 100 and the cover members 25, and it is possible to easily dry ink on the medium 100 by the drying air flow Fd. Also, since the preliminary air Ap entering the dryer 20 from the outside is also sucked downward by the air intake fans 120, the flow direction of a high proportion of the preliminary air can be changed such that the preliminary air is introduced into the gap between the medium 100 and the cover members 25.

Figure 14:
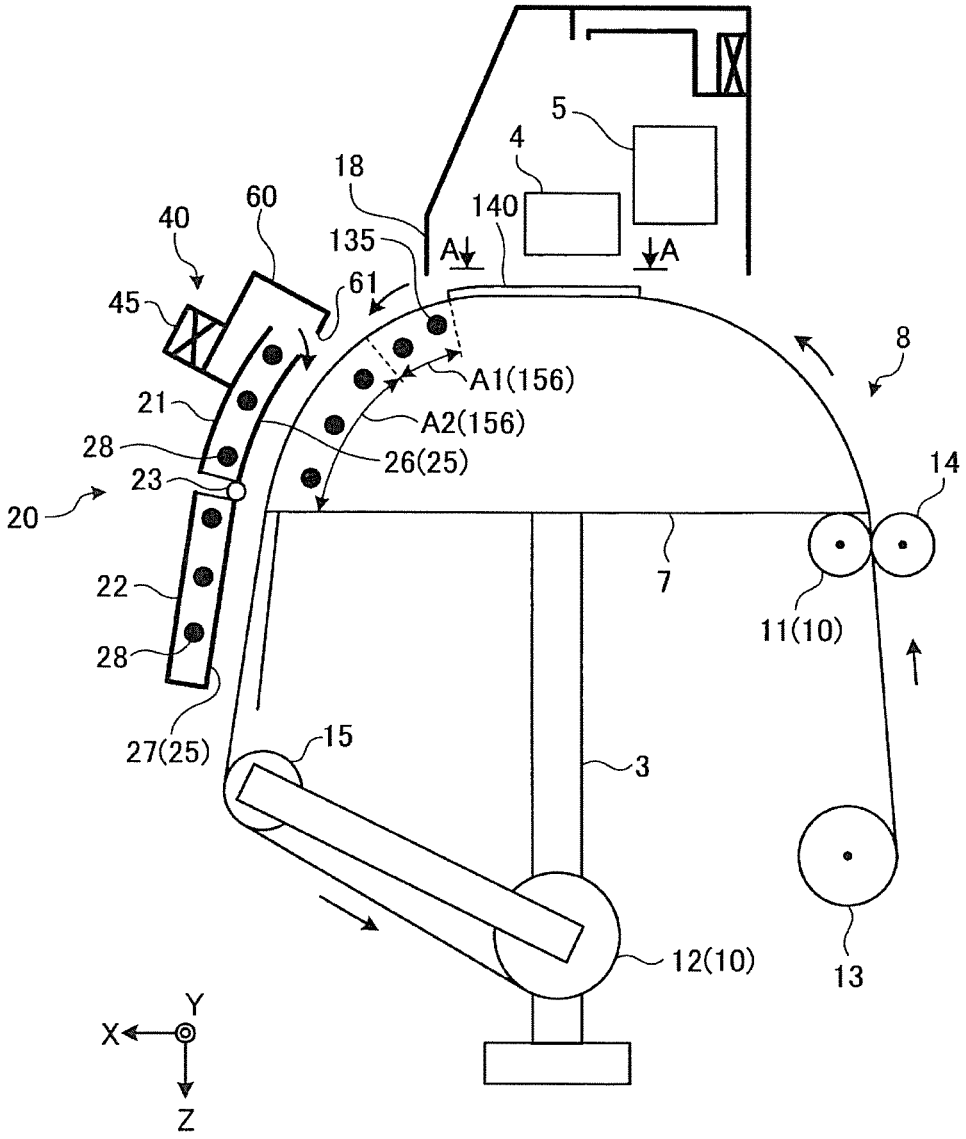
FIG. 14 is a view for explaining a cord type heater which is provided in an after-platen, as another modification of the printing apparatus according to the embodiment.
Figure 15:
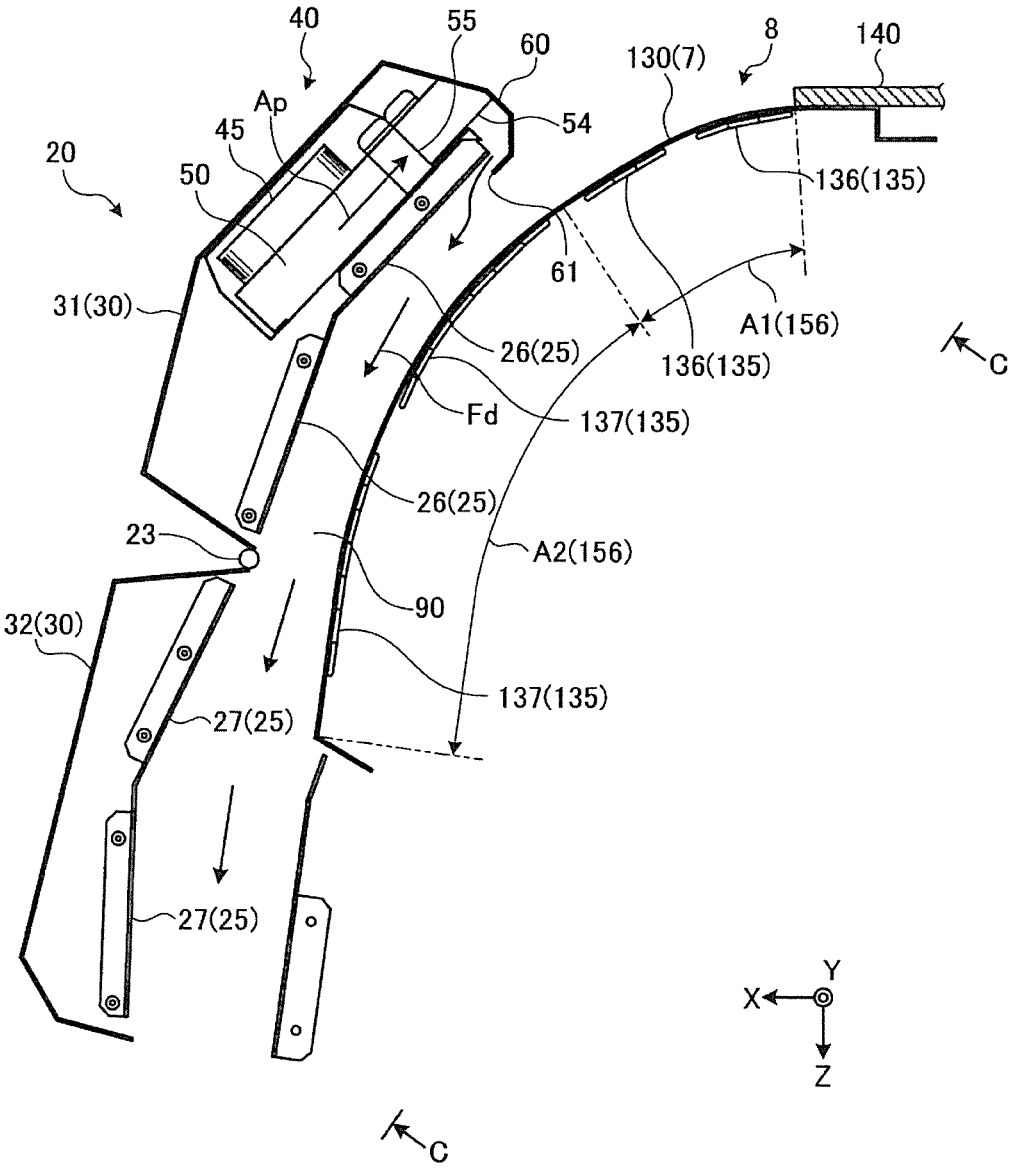
FIG. 15 is a detailed view of a portion including the after-platen shown in FIG. 14.
Figure 16:
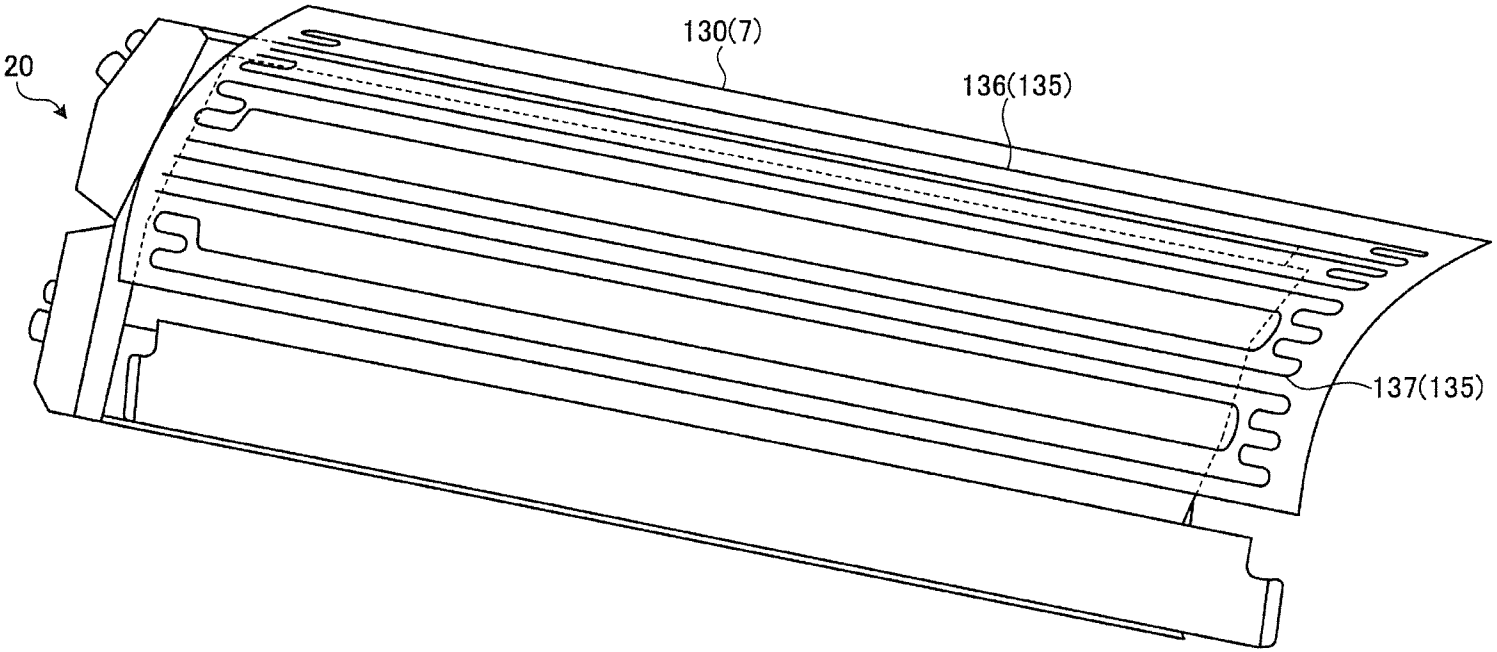
FIG. 16 is a view as seen in a direction shown by arrows C-C of FIG. 15.

Also, heater may be provided on the platen 7, and the set temperatures of the heater may differ depending on positions on the conveyance path 8. FIG. 14 is a view for explaining cord type heaters which are provided on an after-platen, as another modification of the printing apparatus according to the embodiment. FIG. 15 is a detailed view of a portion including the after-platen shown in FIG. 14. FIG. 16 is a view as seen in a direction shown by arrows C-C of FIG. 15. In the case of providing heater on the platen 7, for example, as shown in FIGS. 14 to 16, cord type heaters 135 may be buried as heater in an after-platen 130 which is a portion of the platen 7 and is positioned on the downstream side from the scanning area of the head 4 in the movement direction of the medium 100. In other words, the after-platen 130 is composed of a member for supporting a portion of the medium 100 positioned on the downstream side from the head 4 in the movement direction of the medium 100 relative to the head 4, and on the after-platen 130, the cord type heaters 135 are provided as recording-medium heater for heating the medium 100. Similarly to the cord type heaters 28 (see FIG. 7) which are bonded to the cover members 25, the cord type heaters 135 are disposed along the main scan direction on the after-platen 130, and are turned in the vicinities of the end portions of the after-platen 130 in the main scan direction. Therefore, portions of the cord type heaters 135 along the main scan direction are disposed in parallel in the movement direction of the medium 100.

As described above, the cord type heaters 135 which are provided on the after-platen 130 are configured such that some of them positioned on the downstream side in the movement direction of the medium 100 heat the medium 100 at a higher temperature than the others positioned on the upstream side. Specifically, on the after-platen 130, as the cord type heaters 135, upstream cord type heaters 136 to be disposed on the relatively upstream side, and downstream cord type heaters 137 to be disposed on the downstream side from the upstream cord type heaters 136 are provided. On the after-platen 130, a heating area 156 is set as an area where the medium 100 is heated by the cord type heaters 135. In other words, since the upstream cord type heaters 136 and the downstream cord type heaters 137 are provided as the cord type heaters 135, as the heating area 156, an upstream area A1 which is an area where heating is performed by the upstream cord type heaters 136, and a downstream area A2 which is an area where heating is performed by the downstream cord type heaters 137 are set.

Specifically, the after-platen 130 where the heating areas 156 are set is formed in a curved shape such that a portion close to the upstream end in the movement direction of the medium 100 gradually curves from a horizontal state to a vertical state as it goes toward the downstream side in the movement direction of the medium 100. The heating area 156 is an area of the after-platen 130 where the cord type heaters 135 are disposed, and is provided from the vicinity of the portion of the after-platen 130 where the curve is formed in the movement direction of the medium 100, to the downstream side in the movement direction of the medium 100. Of the upstream area A1 and the downstream area A2 constituting the heating area 156, the upstream area A1 is set such that the length in the movement direction of the medium 100 becomes about one-third of the length of the heating area 156, and the downstream area A2 is set such that the length in the movement direction of the medium 100 becomes about two-third of the length of the heating area 156. In other words, the upstream cord type heaters 136 are disposed in the range of one-third of the heating area 156 positioned on the upstream side in the movement direction of the medium 100, and the downstream cord type heaters 137 are disposed in the range of two-third of the heating area 156 positioned on the downstream side in the movement direction of the medium 100.

Also, the set temperatures of the cord type heaters 135 for heating differ between the upstream cord type heaters 136 and the downstream cord type heaters 137, and the set temperature T2 of the downstream cord type heaters 137 is set to be higher than the set temperature T1 of the upstream cord type heaters 136. In other words, in the heating area 156 for heating the medium 100, the set temperature T2 of the downstream area A2 is set to be higher than the set temperature T1 of the upstream area A1. For example, the set temperature T2 of the downstream area A2 may be set to be higher than the set temperature T1 of the upstream area A1 by about 10° C., and the set temperature T1 of the upstream area A1 and the set temperature T2 of the downstream area A2 may be appropriately set to have such a temperature difference.

In the case where the cord type heaters 135 are provided on the after-platen 130 as described above, during printing of the printing apparatus 1, if a portion of the medium 100 where ink ejected from the head 4 has landed reaches the position of the heating area 156, it is possible to heat the medium 100 by the cord type heaters 135. In this way, the cord type heaters 135 can dry ink on the medium 100. In this case, in the heating area 156, the set temperature T1 of the upstream area A1 is set to be higher than the set temperature T2 of the downstream area A2, and the upstream area A1 is provided as an area for performing low-temperature drying, and the downstream area A2 is provided as an area for performing high-temperature drying.

Therefore, when the medium 100 passes the heating area 156, ink on the medium is moderately dried at a relatively low temperature by the upstream cord type heaters 136 in the upstream area A1, and then is appropriately dried at a relatively high temperature by the downstream cord type heaters 137 in the downstream area A2. In this way, when the medium 100 passes the heating area 156, the upstream area A1 serves as a buffer zone for suppressing sudden drying. Therefore, it is possible to suppress cockling from occurring.

Figure 17:
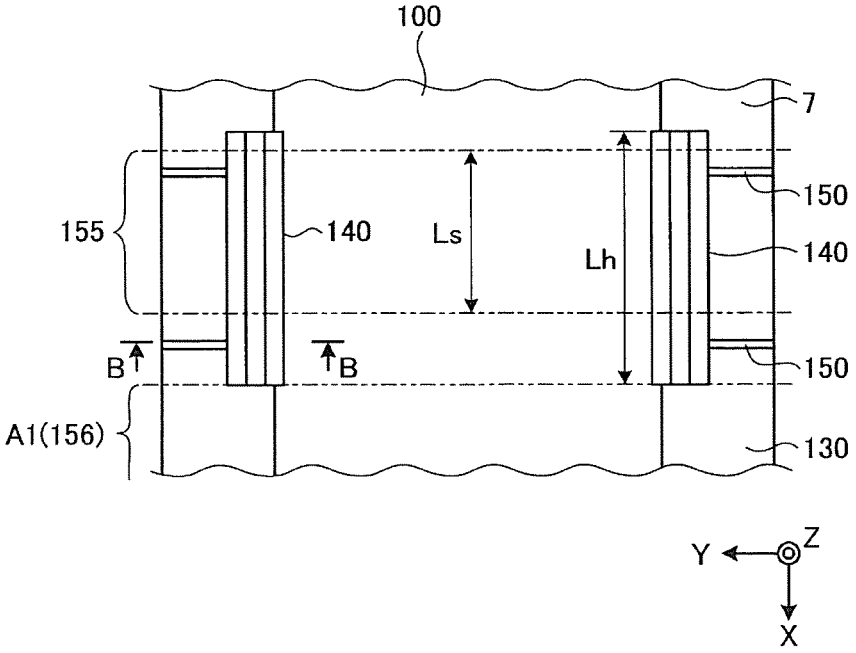
FIG. 17 is a view as seen in a direction shown by arrows A-A of FIG. 14.
Figure 18:
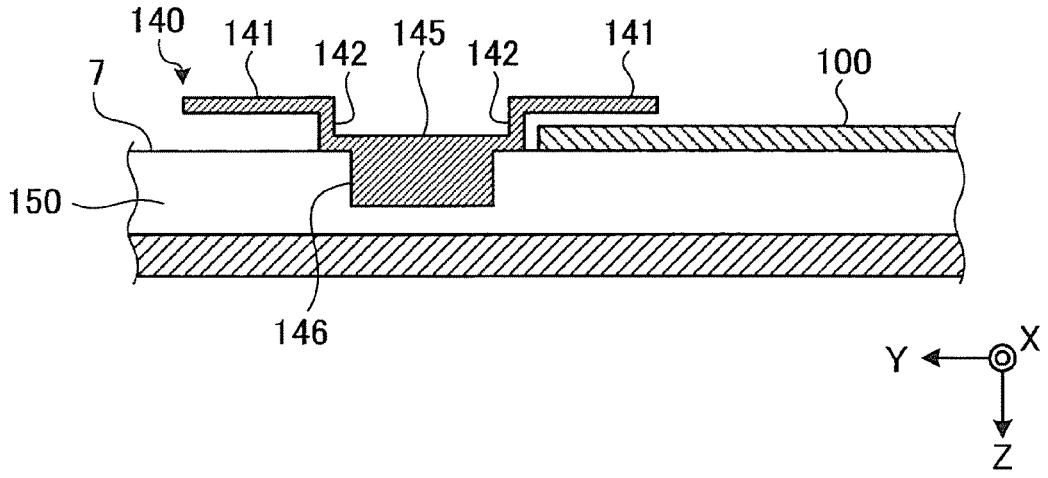
FIG. 18 is a view as seen in a direction shown by arrows B-B of FIG. 17.

Also, on the platen 7, members for supporting the medium 100 moving during printing may be provided. FIG. 17 is a view as seen in a direction shown by arrows A-A of FIG. 14. FIG. 18 is a view as seen in a direction shown by arrows B-B of FIG. 17. As the members for supporting the medium 100, for example, as shown in FIGS. 14 to 18, medium pressing members 140 which are recording medium members for regulating movement of the medium 100 in the width direction and thickness direction of the medium 100 may be attached to the platen 7. In a head scan area 155 which is an area where the head 4 ejects ink onto the medium 100, in the movement direction of the medium 100 relative to the head 4, the medium pressing members 140 are disposed at two positions corresponding to the positions of both ends of the medium 100 in the main scan direction. Also, the head scan area 155 is an area where the head 4 reciprocates in the main scan direction during printing of the printing apparatus 1, that is, an ejectable area where the head 4 can eject ink.

The medium pressing members 140 which are provided at two positions corresponding to the positions of both ends of the medium 100 in the main scan direction as described above are disposed throughout the head scan area 155 and the position of the upstream end of the heating area 156 in the movement direction of the medium 100 relative to the head 4. In other words, the medium pressing members 140 are disposed from a position in the vicinity of the upstream end of the head scan area 155 in the movement direction of the medium 100 to the position of the upstream end of the upstream area A1 of the heating area 156. Therefore, the length Lh of the medium pressing members 140 in the sub scan direction is greater than the length Ls of the head scan area 155 in the sub scan direction.

The medium pressing members 140 which are provided as described above include vertical direction regulation parts 141 for regulating movement of the medium 100 upward, horizontal direction regulation parts 142 for regulating movement of the medium in a horizontal direction, and base parts 145 which are used to attach the medium pressing members 140 to the platen 7. Of them, the horizontal direction regulation parts 142 are provided as wall parts which are connected to end portions of the base parts 145 in the sub scan direction and protrude upward from the end portions of the base parts 145. Also, the vertical direction regulation parts 141 are provided as wall parts which protrude from the upper end portions of the horizontal direction regulation parts 142 toward the opposite sides of the horizontal direction regulation parts 142 to the base parts 145 in the main scan direction. In other words, each of pairs of the vertical direction regulation parts 141 and the horizontal direction regulation parts 142 is formed substantially in an inverted L shape as the medium pressing members 140 are seen in the sub scan direction.

Two pairs of the vertical direction regulation parts 141 and the horizontal direction regulation parts 142 are provided at two positions of one medium pressing member 140, and those pairs of the vertical direction regulation parts 141 and the horizontal direction regulation parts 142 are provided on both sides of the corresponding medium pressing member 140 in the main scan direction. In other words, each medium pressing member 140 is formed so as to be axis-symmetrical with respect to the central portion in the main scan direction as the corresponding medium pressing member 140 is seen in the sub scan direction.

The base parts 145 have engagement portions 146 which are fit into grooves 150 which are formed in the platen 7, whereby the medium pressing members 140 which are formed as described above are attached to the platen 7. The plurality of grooves 150 is formed in the surface of the platen 7 for mounting the medium 100, so as to extend in the main scan direction. The engagement portions 146 of the medium pressing members 140 are formed at positions on the lower surfaces of the base parts 145 corresponding to the grooves 150 of the platen 7, so as to protrude downward. The engagement portions 146 are fit into the grooves 150 of the platen 7, whereby the medium pressing members 140 are attached to the platen 7.

In this case, two medium pressing members 140 are attached to the platen 7 such that the interval between horizontal direction regulation parts 142 included in the two medium pressing members 140 and facing each other is slightly larger than the width of the medium 100 in the main scan direction. In this way, the medium pressing members 140 are disposed throughout at least the head scan area 155 in the movement direction of the medium 100, and are attached to the platen 7 such that the interval between the horizontal direction regulation parts 142 of the two medium pressing members 140 is slightly larger than the width of the medium 100 in the main scan direction.

The medium pressing members 140 are attached to the platen 7 with a gap between the vertical direction regulation parts 141 of the medium pressing members 140 and the platen 7. During printing of the printing apparatus 1, the medium 100 which moves on the platen 7 passes through the gap between the vertical direction regulation parts 141 and the platen 7. Therefore, movement of the medium 100 upward is regulated by the vertical direction regulation parts 141. Also, since the medium 100 which moves on the platen 7 passes between the horizontal direction regulation parts 142 of the medium pressing members 140 disposed near both ends of the medium 100 in the main scan direction, movement of the medium 100 in the main scan direction is regulated by the horizontal direction regulation parts 142. As described above, during printing of the printing apparatus 1, it is possible to regulate movement of the medium 100 in the vertical direction and the main scan direction, that is, movement of the medium 100 in the thickness direction and width direction of the medium 100. Therefore, it is possible to suppress cockling from occurring.

Also, since the medium pressing members 140 are disposed throughout the head scan area 155 and the position of the upstream end of the upstream area A1 included in the heating area 156 in the movement direction of the medium 100 relative to the head 4, in a state where ink ejected on the medium 100 is wet, it is possible to hold the medium 100 by the medium pressing members 140. Since the medium 100 moves to the heating area 156 while being held by the medium pressing members 140, after a predetermined time from ink ejection, drying is performed in the heating area 156. Therefore, it becomes difficult for the medium 100 to be suddenly deformed, and it is possible to effectively suppress cockling from occurring.

Also, since each medium pressing member 140 is formed such that the shape in the main scan direction is symmetrical with respect to the central portion in the main scan direction, it is possible to use each medium pressing member 140 on any end portion side of both end portions of the medium 100 in the main scan direction. However, the medium pressing members 140 do not necessarily need to have a symmetrical shape in the main scan direction. As long as the medium pressing members 140 have the vertical direction regulation parts 141 and the horizontal direction regulation parts 142, it is possible to regulate movement of the medium 100 in the vertical direction and the main scan direction.

Also, in the printing apparatus 1 according to the above described embodiment, in the printing apparatus main body 2, the head 4 is provided so as to move along the Y bar 5, and during printing, the head 4 performs printing while reciprocating in the main scan direction. However, the head 4 may be provided so as to extend in the main scan direction. In other words, the head 4 may be provided so as to be able to eject ink over the entire print range in the main scan direction, and be configured such that, during printing, the head 4 can perform printing on the entire print range in the main scan direction at once without moving in the main scan direction. As long as the printing apparatus main body 2 is configured so as to be able to eject ink onto the medium 100 and be able to convey the medium 100 to the position of the dryer 20 after ink lands on the medium, the configuration of the head 4 does not matter.

Also, the above described printing apparatuses 1 according to the embodiment and modifications of the present disclosure are not limited to the embodiment and the modifications described above, and the components of the embodiment and the modifications can be appropriately combined.

What is claimed is:

1. A printing apparatus, comprising:

a head that ejects an ink onto a recording medium;

a driver that relatively moves positions of the head and the recording medium;

a cover member that is positioned on a downstream side from the head in a movement direction of the recording medium relative to the head, so as to cover at least a portion of the recording medium;

a drying-air-flow supply that sends a drying air flow for drying the ink ejected on the recording medium, into a gap between the recording medium and the cover member;

a heater that heats either one or both of the drying air flow and a preliminary air before becomes the drying air flow flowing between the recording medium and the cover member; and an air flow path, being inclined downward in a moving direction of the recording medium in the gap defined between the recording medium and the cover member, wherein a flow path changer is provided so as to change a flow direction of the preliminary air which is the previous stage of the drying air flow, at least once;

the drying-air-flow supply is an air blower for blowing the preliminary air, and the flow path changer is an air-flow-direction changing wall part configured such that the preliminary air blown from the air blower collides with the air-flow-direction changing wall part, whereby the flow direction of the preliminary air is changed, the heater heating the drying air flow in the air flow path is provided in the cover member, at least one of the drying air flow and the preliminary air is blown from above the air flow path by the drying-air-flow supply and the flow path changer.

2. The printing apparatus according to claim 1, wherein a widening duct in fan shape that spreads the preliminary air blown by the air blower, in a direction perpendicular to the movement direction of the recording medium is disposed, and in the widening duct, near a leading end portion in an air blowing direction, a plurality of current plates extending in the flow direction of the preliminary air blown from the air blower is provided in a line in a width direction.

3. The printing apparatus according to claim 1, wherein the flow path changer is an air blower for blowing the preliminary air positioned on an opposite side of the cover member to the recording medium, into the gap between the recording medium and the cover member.

4. The printing apparatus according to claim 1, wherein the flow path changer is an air breather for sucking the drying air flow.

5. The printing apparatus according to claim 1, wherein the flow path changer changes the flow direction of the preliminary air such that the preliminary air flows toward a lower side in the gap between the recording medium and the cover member.

6. The printing apparatus according to claim 1, wherein the heater comprises a cord type heater, and is bonded to the cover member, and the heater heats the cover member, thereby heating the drying air flow.

7. The printing apparatus according to claim 6, wherein the cord type heater is disposed throughout a width direction of the recording medium in a direction perpendicular to the movement direction of the recording medium.

8. The printing apparatus according to claim 1, wherein after the flow direction of all of the preliminary air is changed by the flow path changer, the preliminary air is used as the drying air flow.

9. The printing apparatus according to claim 1, wherein between the head and an air outlet from which an air is sent out after the flow direction of the air is changed by the flow path changer, a partition plate is disposed to separate the air outlet and the head.

10. The printing apparatus according to claim 1, wherein the cover member includes: a first cover part, and a second cover part which is positioned on the downstream side from the first cover part in the movement direction of the recording medium, on the cover member, a rotator which rotates on a rotating shaft extending in a direction perpendicular to the movement direction of the recording medium is connected, and the first cover part and the second cover part are connected by the rotator so as to be rotatable with respect to each other.

11. The printing apparatus according to claim 1, further comprising:

an after-platen that supports a portion of the recording medium positioned on the downstream side from the head in the movement direction of the recording medium relative to the head; and a recording-medium heater that is disposed on the after-platen, and heats the recording medium, wherein the recording-medium heater is configured such that a downstream area in the movement direction of the recording medium heats the recording medium at a higher temperature as compared to an upstream area.

12. The printing apparatus according to claim 1, further comprising:

recording medium members that regulate movement of the recording medium in a width direction and a thickness direction of the recording medium, wherein, in the movement direction of the recording medium relative to the head, the recording medium members are disposed in an area where the head ejects the ink onto the recording medium.

13. The printing apparatus according to claim 1, further comprising:

an after-platen that supports a portion of the recording medium positioned on the downstream side from the head in the movement direction of the recording medium relative to the head;

a recording-medium heater that is disposed on the after-platen, and heats the recording medium; and recording medium members that regulate movement of the recording medium in a width direction and a thickness direction of the recording medium, wherein, in the movement direction of the recording medium relative to the head, the recording medium members are disposed throughout an area where the head ejects the ink onto the recording medium and a position of an upstream end of an area where the recording-medium heater is disposed.

14. A printing apparatus, comprising:

a head that ejects an ink onto a recording medium;

a driver that relatively moves positions of the head and the recording medium;

a platen for mounting the recording medium;

a cover member that is positioned on a downstream side from the head in a movement direction of the recording medium relative to the head, so as to cover at least a portion of the recording medium;

a drying-air-flow supply that sends a drying air flow for drying the ink ejected on the recording medium, into a gap between the recording medium and the cover member; and a heater that heats either one or both of the drying air flow and a preliminary air before becomes the drying air flow flowing between the recording medium and the cover member; and an air flow path, being inclined downward in a moving direction of the recording medium in the gap defined between the recording medium and the cover member, wherein the cover member is a boxed member formed in a box shape and having an internal space filled with air, and the boxed member contains the heater and the drying-air-flow supply, the heater heating the drying air flow in the air flow path is provided in the cover member, at least one of the drying air flow and the preliminary air is blown from above the air flow path by the drying-air-flow supply and the flow path changer.

15. The printing apparatus according to claim 14, wherein the drying-air-flow supply is disposed on an opposite side of the heater to the platen.

16. The printing apparatus according to claim 14, wherein the cover member is formed in long shape along the platen in a direction of gravity, and an opening for sending out the drying air flow or the preliminary air is formed at a top of the boxed member in the direction of gravity, and the drying air flow or the preliminary air is sent from the opening by the drying-air-flow supply, whereby the drying air flow is introduced into the gap between the platen and the cover member.

* * * * *